US007824024B2

(12) United States Patent
Nakamura et al.

(10) Patent No.: US 7,824,024 B2
(45) Date of Patent: Nov. 2, 2010

(54) LIQUID DISCHARGE DEVICE

(75) Inventors: Hirotake Nakamura, Nagoya (JP); Takaichiro Umeda, Nagoya (JP); Fumio Nakazawa, Okazaki (JP); Kosuke Nukui, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 323 days.

(21) Appl. No.: 12/005,988

(22) Filed: Dec. 28, 2007

(65) Prior Publication Data

US 2008/0158284 A1 Jul. 3, 2008

(30) Foreign Application Priority Data

Dec. 29, 2006 (JP) ..... 2006-356791

(51) Int. Cl.
*B41J 2/175* (2006.01)

(52) U.S. Cl. ..... 347/85

(58) Field of Classification Search ..... 347/85
See application file for complete search history.

(56) References Cited

U.S. PATENT DOCUMENTS

| | | | | |
|---|---|---|---|---|
| 6,991,325 | B2 | 1/2006 | Oda et al. | |
| 2008/0158310 | A1 * | 7/2008 | Nakamura et al. | 347/85 |
| 2008/0158311 | A1 * | 7/2008 | Kaga | 347/85 |
| 2008/0158312 | A1 * | 7/2008 | Kaga | 347/85 |

FOREIGN PATENT DOCUMENTS

| | | |
|---|---|---|
| JP | 2002113878 | 4/2002 |
| JP | 2002190677 | 7/2002 |
| JP | 2004-34336 | 2/2004 |
| JP | 2005-41140 | 2/2005 |

OTHER PUBLICATIONS

U.S. Appl. No. 12/005,758, filed Dec. 28, 2007, Bro. Kogyo Kabushiki Kaisha.
U.S. Appl. No. 12/005,724, filed Dec. 29, 2006, Brother Kogyo Kabushiki Kaisha.
U.S. Appl. No. 12/005,472, filed Dec. 27, 2007, Bro. Kogyo Kabushiki Kaisha.

* cited by examiner

*Primary Examiner*—Huan H Tran
(74) *Attorney, Agent, or Firm*—Frommer Lawrence & Haug LLP

(57) ABSTRACT

A liquid discharge device may be provided with a discharge head comprising a nozzle for discharging liquid, a first member communicating with the discharge head, and a second member capable of being connected to the first member. A liquid path from a liquid supply source to the discharge head via the second member and the first member is formed when the second member is in a connected state with the first member. One of the first member and the second member may comprise an insertion hole. In s case where the other of the first member and the second member is inserted into the insertion hole by moving the first member and/or the second member in a predetermined direction, the second member may be connected with the first member. The liquid discharge device may be provided with a first sealing member that seals between the first member and the second member by being compressed in the predetermined direction when the second member is in the connected state with the first member, and a second sealing member that seals between the first member and the second member by being compressed in a direction which is perpendicular to the predetermined direction when the second member is in the connected state with the first member.

8 Claims, 17 Drawing Sheets

LIQUID DISCHARGE DEVICE

CROSS-REFERENCE TO RELATED APPLICATION

This application claims priority to Japanese Patent Application No. 2006-356791, filed on Dec. 29, 2006, the contents of which are hereby incorporated by reference into the present application.

BACKGROUND OF THE INVENTION

1. Field of the Invention

The technique taught in the present specification relates to a liquid discharge device. This technique relates to, for example, an ink jet recording device that records an image onto a recording medium by discharging ink from a discharge head.

2. Description of the Related Art

Japanese Patent Application Publication Nos. 2002-113878 and 2005-41140, or U.S. Pat. No. 6,991,325, for example, teach an ink jet printer comprising a discharge head, and an ink supply source that stores ink to be supplied to the discharge head, the discharge head and the ink supply source being configured separately. In this type of ink jet printer, a first joint part may be provided at the discharge head side, and a second joint part may be provided at the ink supply source side. The second joint part is capable of being connected to the first joint part. An ink path from the ink supply source to the discharge head via the second joint part and the first joint part may be formed when the first joint part and the second joint part are in a connected state.

BRIEF SUMMARY OF THE INVENTION

The technique taught in the present specification is capable of effectively sealing between members in order to connect a discharge head side and a liquid supply source side.

One technique taught in the present specification is a liquid discharge device. The liquid discharge device may comprise a discharge head, a first member, and a second member. The discharge head comprises a nozzle for discharging liquid. The first member communicates with the discharge head. The second member is capable of being connected to the first member. A liquid path from a liquid supply source to the discharge head via the second member and the first member may be formed when the second member is in a connected state with the first member. One of the first member and the second member may comprise an insertion hole. The second member may be connected with the first member in a case where the other of the first member and the second member is inserted into the insertion hole by moving the first member and/or the second member in a predetermined direction. The liquid discharge device may also comprise a first sealing member and a second member. The first sealing member may seal between the first member and the second member by being compressed in the predetermined direction when the second member is in the connected state with the first member. The second sealing member may seal between the first member and the second member by being compressed in a direction which is perpendicular to the predetermined direction when the second member is in the connected state with the first member. With this configuration, it is possible to effectively seal between the first member and the second member by utilizing the two sealing members that are compressed in differing directions to achieve the seals.

DETAILED DESCRIPTION OF THE PREFERRED EMBODIMENTS

First Embodiment

Figure 1:
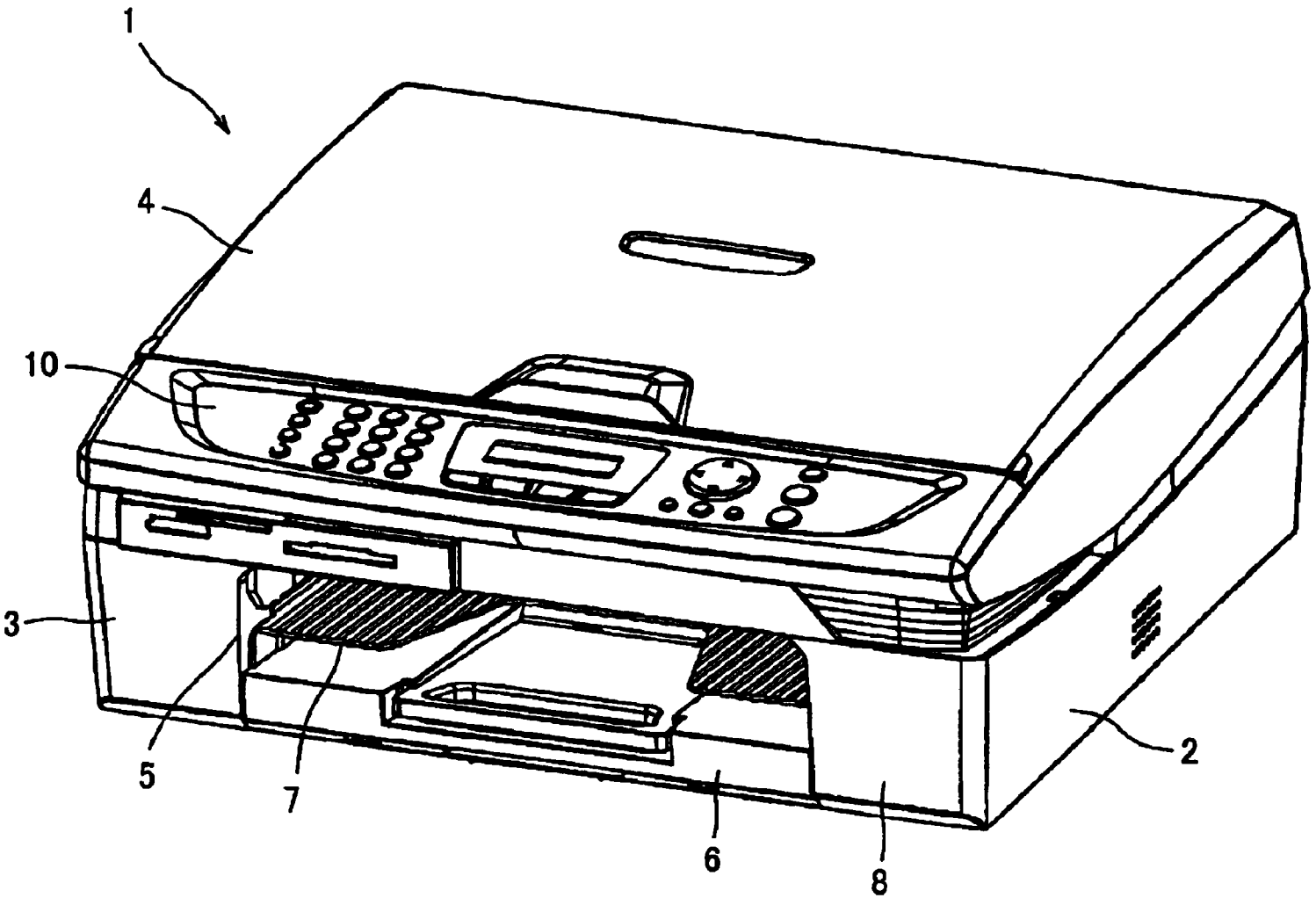
FIG. 1 shows a perspective view of a multi function device provided with an ink jet recording device.

FIG. 1 shows a perspective view of a multi function device 1 provided with an ink jet recording device 3. The multi function device 1 has a printer function, scanner function, copy function, and facsimile function. The multi function device 1 has a casing 2, the ink jet recording device 3 disposed within a lower part of the casing 2, and a scanner device 4 disposed within an upper part of the casing 2. An opening 5 is formed in a front surface of the casing 2. A paper supply tray 6 of the ink jet recording device 3 is disposed in a lower part of the opening 5. A paper discharge tray 7 of the ink jet recording device 3 is disposed in an upper part of the opening 5. An opening and closing cover 8 is formed at a lower right side of a front surface side of the ink jet recording device 3. A main tank mounting part 9 (see FIG. 3) is formed at an inner side of the opening and closing cover 8. An operation panel 10 for operating the ink jet recording device 3, the scanner device 4, etc. is formed at an upper part of a front surface side of the multi function device 1. Further, in the case where an external computer is connected, the multi function device 1 is capable of operating on the basis of commands transmitted from the computer via a driver.

Figure 2:
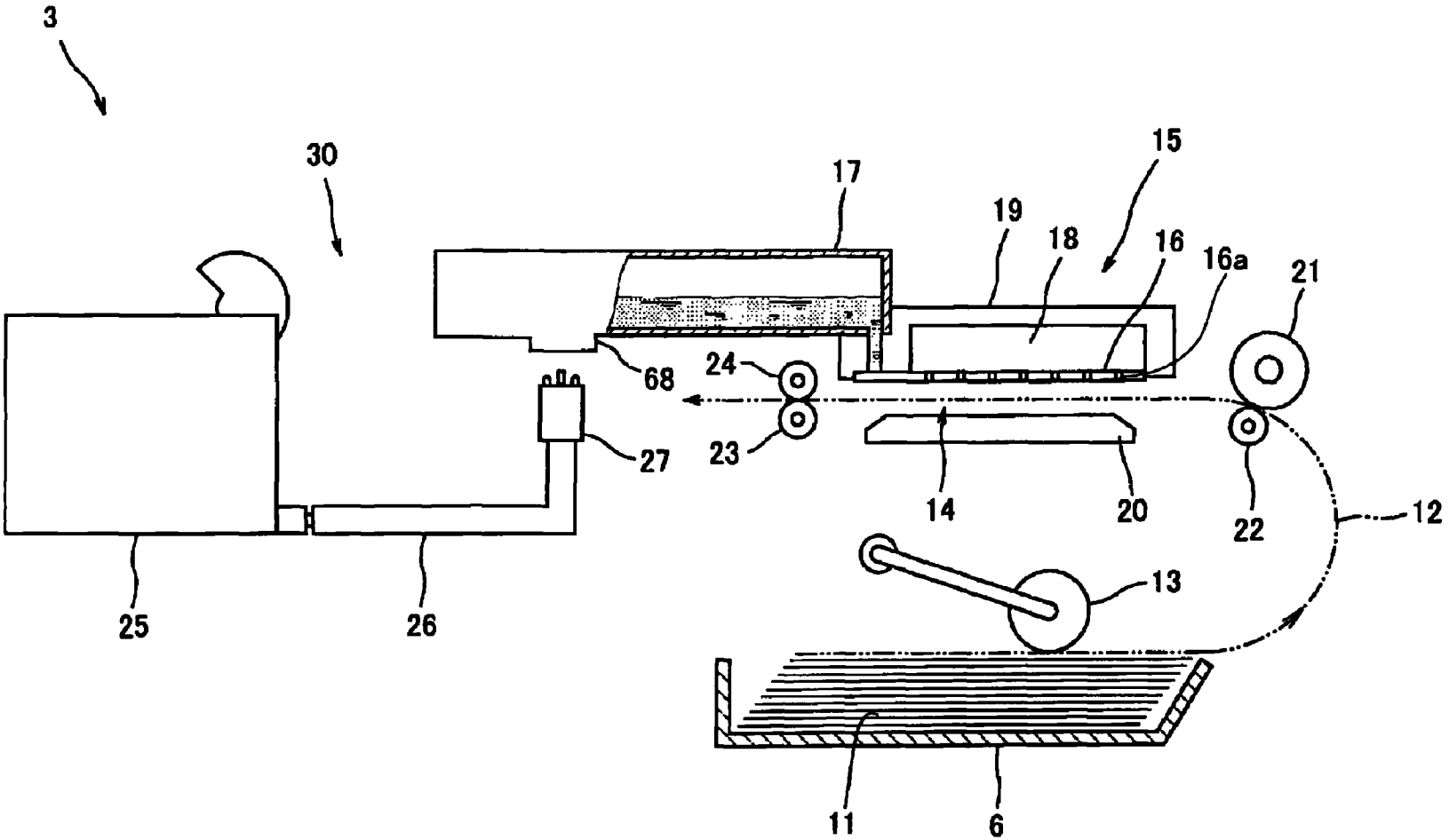
FIG. 2 shows a schematic cross-sectional view of the ink jet recording device.

FIG. 2 shows a schematic cross-sectional view of the ink jet recording device 3. The paper supply tray 6 is disposed at a bottom side of the multi function device 1. A paper supply driving roller 13 is disposed at an upper side of the paper supply tray 6. The paper supply driving roller 13 supplies an uppermost sheet of paper 11 stacked in the paper supply tray 6 to a feeding path 12. The feeding path 12 extends upwards from a back surface side of the paper supply tray 6 and then forms a U-turn to face toward a front surface side thereof. The feeding path 12 passes a printing region 14 and extends to the paper discharge tray 7 (see FIG. 1).

An image recording unit 15 is disposed in the printing region 14. A platen 20 that is larger than the paper size is disposed below the image recording unit 15. A feeding roller 21 and a pinch roller 22 are disposed at an upstream side of the image recording unit 15 along a paper transportation direction. The rollers 21 and 22 feed the paper 11 toward the platen 20. A paper discharge roller 23 and a pinch roller 24 are disposed at a downstream side of the image recording unit 15 along the paper transportation direction. The rollers 23 and 24 feed the paper 11 that has had an image printed thereon toward the paper discharge tray 7 (see FIG. 1).

The image recording unit 15 comprises a discharge head 16, a sub tank 17, a head controlling substrate 18, and a carriage 19. The discharge head 16 has a plurality of nozzle holes 16*a*. The discharge head 16 discharges ink towards the platen 20 from the nozzle holes 16*a*. The discharge head 16 may be a commonly known piezoelectric driven type. The sub tank 17 stores ink to be supplied to the discharge head 16. The head controlling substrate 18 controls the operation of the discharge head 16. The discharge head 16, sub tank 17, and head controlling substrate 18 are mounted on the carriage 19.

The sub tank 17 has a first joint part 68. The ink jet recording device 3 is provided with an ink replenishment mechanism 30. The first joint part 68 can be connected with the ink replenishment mechanism 30. Ink can be replenished into the sub tank 17 when the first joint part 68 and the ink replenishment mechanism 30 are in a connected state. The ink replenishment mechanism 30 is provided with a main tank 25, an ink supply tube 26, and a second joint part 27. The main tank 25 is housed detachably in the main tank mounting part 9 shown in FIG. 3. The main tank 25 is a cartridge type. One end of the ink supply tube 26 is connected with the main tank 25. The other end of the ink supply tube 26 is connected with the second joint part 27. The second joint part 27 is capable of moving in a vertical direction. The second joint part 27 is thus attached to and detached from the first joint part 68 of the sub tank 17. The second joint part 27 is connected to the first joint part 68 when the second joint part 27 is raised. In this state, the main tank 25 communicates with the sub tank 17 via the ink supply tube 26. That is, an ink replenishment path 26, 27*a*, 72 is in a connected state.

The discharge head 16 scans (moves) in order to record the image on the paper 11. By contrast, the main tank 25 is fixed in the main tank mounting part 9 (see FIG. 3). For moving the discharge head 16, it is preferred that the image recording unit 15 has a simple configuration, and that space is saved. If a configuration is adopted in which the first joint part 68 is not moved and in which the second joint part 27 is moved in the vertical direction, the configuration of the image recording unit 15 can be made simple.

Figure 3:
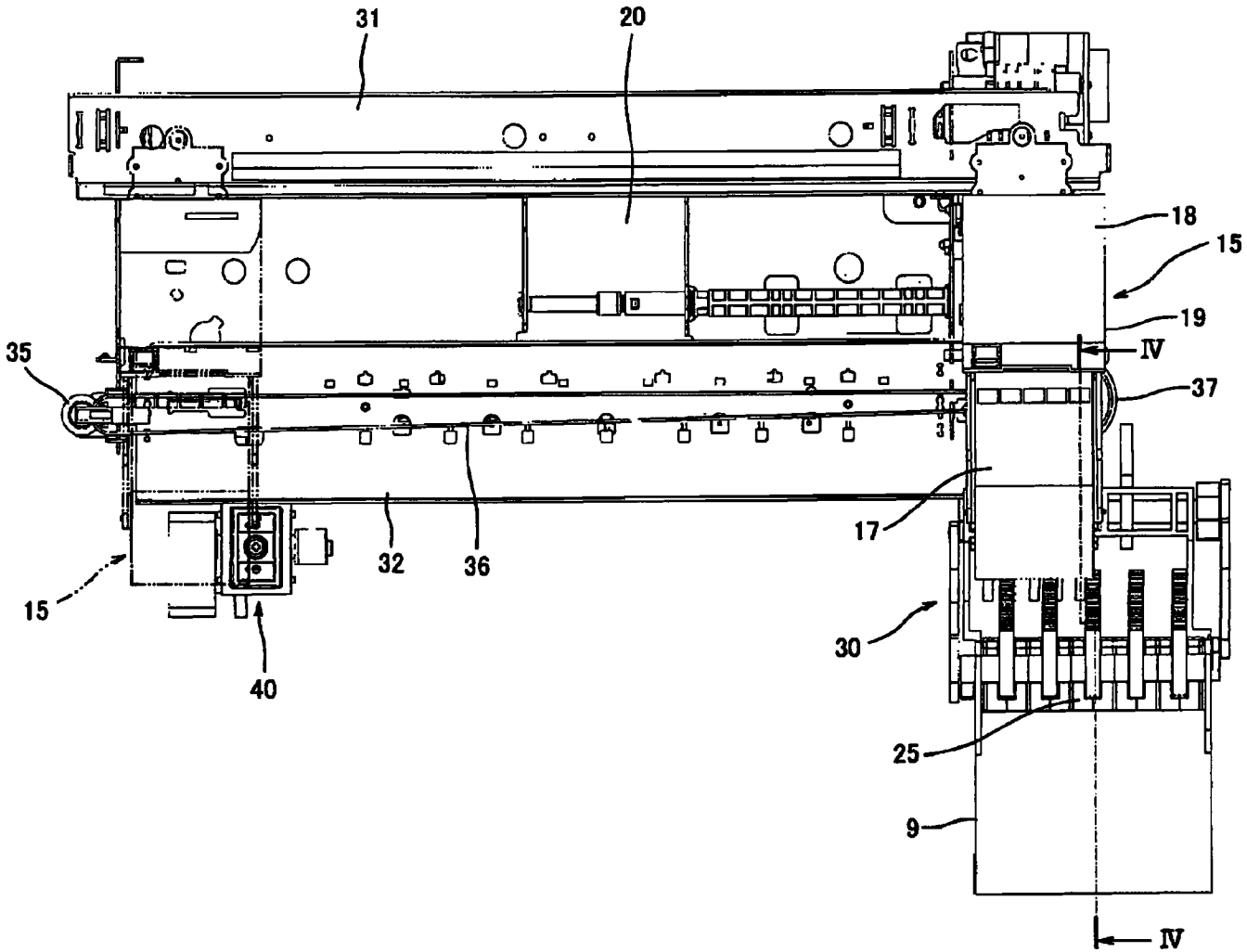
FIG. 3 shows a plan view of the ink jet recording device.

FIG. 3 shows a plan view of the ink jet recording device 3. A pair of guide rails 31 and 32 is disposed above the platen 20. The guide rails 31 and 32 have a flat plate shape. The guide rails 31 and 32 extend along a scanning direction that is orthogonal to a paper feeding direction (the up-down direction in FIG. 3). The guide rails 31 and 32 are formed on substantially the same plane. Upper surfaces of the guide rails 31 and 32 are substantially parallel to an upper surface of the platen 20, and are formed so as to be horizontal. The guide rails 31 and 32 support the carriage 19 of the image recording unit 15. The carriage 19 is capable of sliding in the direction in which the guide rails 31 and 32 extend (the left-right direction in FIG. 3).

A driving pulley (not shown) and a driven pulley 35 are disposed at the upper surface of the guide rail 32 that is located at the downstream side in the paper transportation direction. The driving pulley is disposed at one end part in the scanning direction. The driven pulley 35 is disposed at the other end part in the scanning direction. A ring shaped timing belt 36 is hung between the driving pulley and the driven pulley 35. A bottom part of the carriage 19 is fixed to a part of the timing belt 36. A motor 37 is connected to an axis of the driving pulley. The motor 37 causes the driving pulley to rotate. The timing belt 36 consequently rotates between the driving pulley and the driven pulley 35. When the timing belt 36 rotates, the carriage 19 moves along the guide rails 31 and 32. The carriage 19 can be made to move back and forth along the guide rails 31 and 32 by changing the direction of rotation of the motor 37. When the carriage 19 moves, the members mounted therein (the discharge head 16, the sub tank 17, and the head controlling substrate 18) move integrally with the carriage 19. The sub tank 17 has five ink storage chambers that correspond to the five colors of ink used in printing. Further, each of the ink storage chambers has a capacity capable of storing a greater amount of ink than that estimated to be consumed in one printing process.

The ink replenishment mechanism 30 and a maintenance mechanism 40 are disposed at an outer side of the printing region which the paper passes. The ink replenishment mechanism 30 is disposed at one end side in the scanning direction of the carriage 19 (the right side in FIG. 3). The ink replenishment mechanism 30 is disposed at a proximate side (the lower side in FIG. 3) of the guide rail 32. The ink replenishment mechanism 30 comprises the main tank mounting part 9. The main tank mounting part 9 is capable of housing five main tanks 25 corresponding to the five colors of ink.

Figure 4:
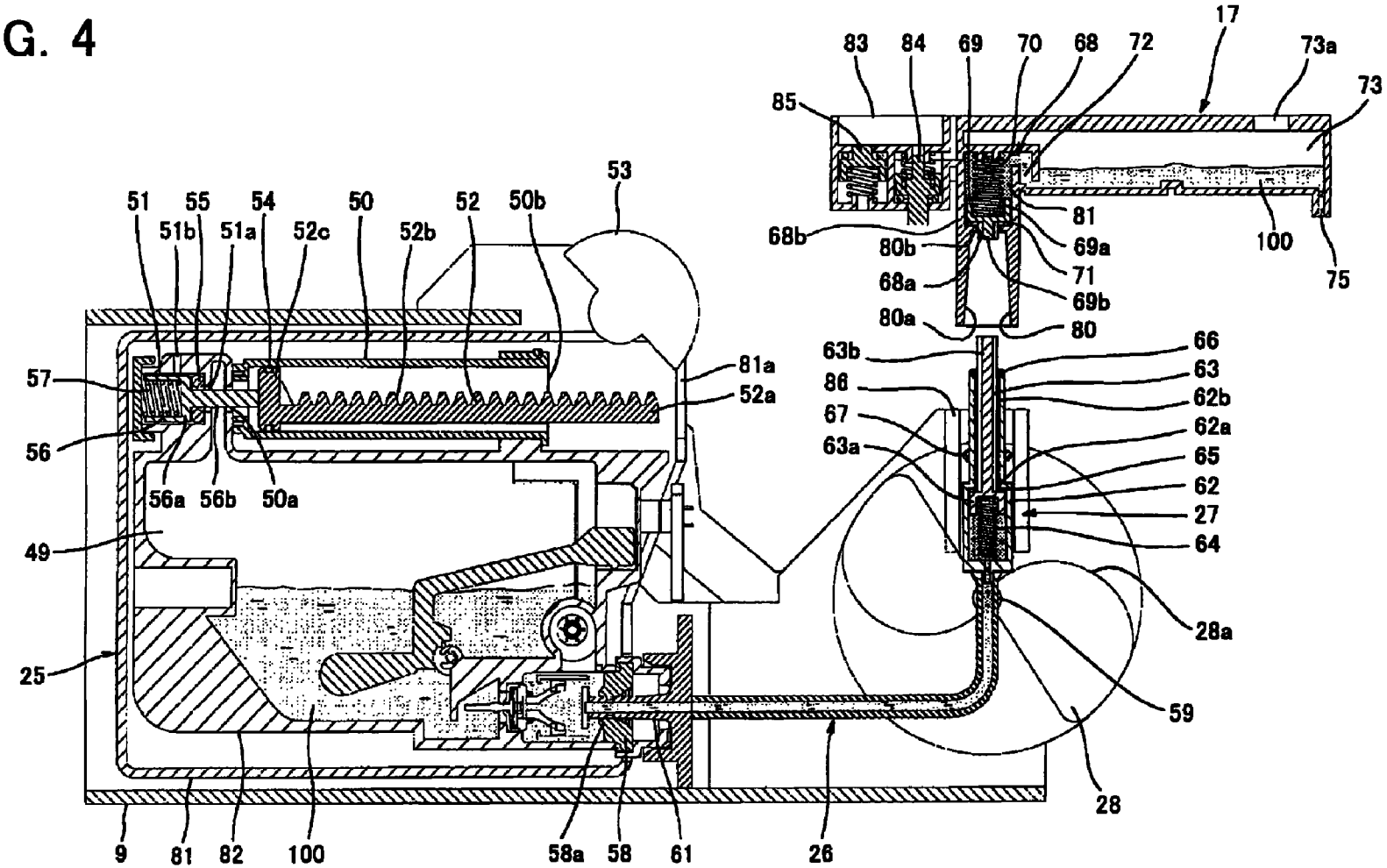
FIG. 4 shows a cross-sectional view along the line IV-IV of FIG. 3. An ink replenishment path is in a disconnected state.

FIG. 4 shows a cross-sectional view along the line IV-IV of FIG. 3. The main tank 25 has an outer case 81 and an inner case 82. The inner case 82 has an ink storage chamber 49 that stores ink 100. A piston pump chamber 50 and a positive pressure controlling chamber 51 are disposed above the ink storage chamber 49. The piston pump chamber 50 is disposed at the right side, and the positive pressure controlling chamber 51 is disposed at the left side. The piston pump chamber 50 communicates with an air layer in a top part of the ink storage chamber 49. A piston 52 is inserted into the piston pump chamber 50 in a manner capable of moving back and forth. The piston 52 comprises a rod part 52*a*, a rack gear part 52*b*, and a piston part 52*c*. The rod part 52*a* has a smaller diameter than the piston pump chamber 50. The rack gear part 52*b* is formed on an upper surface of the rod part 52*a*. The piston part 52*c* is disposed at a left end part of the rod part 52*a*. An O ring 54 is attached to the piston part 52*c*. The O ring 54 makes contact with an inner circumference surface of the piston pump chamber 50. Gas is consequently unable to pass between a right side and a left side of the O ring 54.

An insertion hole 50*a* and an opening part 50*b* are formed in the piston pump chamber 50. The insertion hole 50*a* is formed in a wall surface facing the positive pressure controlling chamber 51. The opening part 50*b* is formed in a wall surface at the other side from the insertion hole 50*a*. The opening part 50*b* allows the rod part 52*a* to pass therethrough. An opening part 81*a* is formed in the outer case 81. The opening part 81*a* is formed by making a notch in a wall surface of a sub tank side of the outer case 81. The opening part 81*a* is formed in a region corresponding to the opening part 50*b* of the piston pump chamber 50. Furthermore, a substantially half-circle shaped pinion gear 53 is disposed at an upper part of the main tank mounting part 9. The pinion gear 53 is driven to rotate by a driving means (not shown). The pinion gear 53 passes through the opening part 81*a* and meshes with the rack gear part 52*b*. That is, when the pinion gear 53 rotates, power is transmitted to the rack gear part 52*b*. The piston 52 can thus move back and forth.

A positive pressure controlling valve 56 is inserted into the positive pressure controlling chamber 51. The positive pressure controlling valve 56 is capable of moving back and forth in a left-right direction. The positive pressure controlling valve 56 comprises a base part 56*a* and a shaft part 56*b*. There is a clearance between the base part 56*a* and an inner circumference surface of the positive pressure controlling chamber 51. This clearance allows communication between the left side and the right side of the base part 56*a*. The shaft part 56*b* protrudes from the base part 56*a* toward the piston 52. A first atmosphere communication hole 51*a* is formed in the positive pressure controlling chamber 51. The first atmosphere communication hole 51*a* is formed in a wall surface facing the piston pump chamber 50. The first atmosphere communication hole 51*a* allows the shaft part 56*b* to pass therethrough. There is a clearance, in the first atmosphere communication hole 51*a*, between the shaft part 56*b* and the positive pressure controlling chamber 51. Further, the shaft part 56*b* passes through the insertion hole 50*a*. There is a clearance, in the insertion hole 50*a*, between the shaft part 56*b* and the piston pump chamber 50. A sealing ring 55 is attached to an inner surface of the positive pressure controlling chamber 51. The sealing ring 55 is disposed between the base part 56*a* and the wall facing the piston pump chamber 50. A coiled spring 57 makes contact with the base part 56*a* of the positive pressure controlling valve 56. The coiled spring 57 biases the base part 56*a* toward the sealing ring 55. Further, a second atmosphere communication hole 51*b* is formed in the positive pressure controlling chamber 51. The second atmosphere communication hole 51*b* is formed in an upper wall surface of the positive pressure controlling chamber 51. The sealing ring 55 is present between the first atmosphere communication hole 51*a* and the second atmosphere communication hole 51*b*. In a normal state there is no communication between the first atmosphere communication hole 51*a* and the second atmosphere communication hole 51*b* because the sealing ring 55 creates a seal between the base part 56*a* and the inner circumference surface of the positive pressure controlling chamber 51.

In the case where positive pressure equal to or above a predetermined value is generated in the ink storage chamber 49, the positive pressure controlling valve 56 separates from the sealing ring 55 against the biasing force of the coiled spring 57. The first atmosphere communication hole 51*a* and the second atmosphere communication hole 51*b* thus communicate. In this case, the ink storage chamber 49 communicates with the atmosphere via the first atmosphere communication hole 51*a* and the second atmosphere communication hole 51*b*. Further, the positive pressure controlling valve 56 separates from the sealing ring 55 against the biasing force of the coiled spring 57 even in the case where the piston 52 moves toward the positive pressure controlling chamber 51 and presses the shaft part 56*b*. In this case, as well, the first atmosphere communication hole 51*a* and the second atmosphere communication hole 51*b* communicate, and the ink storage chamber 49 communicates with the atmosphere.

A tube connecting part 58 capable of deforming elastically is disposed at a lower part of the main tank 25. The tube connecting part 58 has a ring shape. An ink hole 58*a* is formed in a center of the tube connecting part 58. The tube connecting part 58 contracts due to resilient force when there is no load, thus closing the ink hole 58*a*. A connecting terminal 61 is connected to one end part of the ink supply tube 26. The connecting terminal 61 is inserted into the tube connecting part 58. The ink supply tube 26 thus communicates with the ink storage chamber 49 of the main tank 25. The second joint part 27 is connected to the other end part of the ink supply tube 26.

The second joint part 27 has a casing 62 that communicates with the ink supply tube 26. An outlet hole 62*a* is formed in an upper wall of the casing 62. A guiding cylindrical part 86 is formed integrally with the main tank mounting part 9. The casing 62 is capable of sliding in an up-down direction along an inner circumference surface of the guiding cylindrical part 86. A cylindrical standing part 62*b* extends upward from an upper surface of the casing 62. The standing part 62*b* extends upward from the surroundings of the outlet hole 62*a*. A first sealing member 66 is attached to an upper end of the standing part 62*b*. The first sealing member 66 is capable of deforming elastically and has a ring shape. A second sealing member 67 is attached to an outer surface of the standing part 62*b*. The second sealing member 67 is disposed in a substantially central position in the vertical direction of the standing part 62*b*. The second sealing member 67 is capable of deforming elastically and has a ring shape.

A second opening and closing valve 63 is inserted into the casing 62 in a manner capable of moving in the vertical direction. The second opening and closing valve 63 has a base part 63*a* and a shaft part 63*b*. There is a clearance between the base part 63*a* and an inner circumference surface of the casing 62. This clearance allows communication between an upper side and a lower side of the base part 63*a*. Further, the shaft part 63*b* extends upward from the base part 63*a*. The shaft part 63*b* passes through the outlet hole 62*a*. There is a clearance, in the outlet hole 62*a*, between the shaft part 63*b* and the inner circumference surface of the casing 62. This clearance allows communication between an upper side and a lower side of the outlet hole 62*a*. There is also a clearance between the standing part 62*b* and the shaft part 63*b*.

Figure 5:
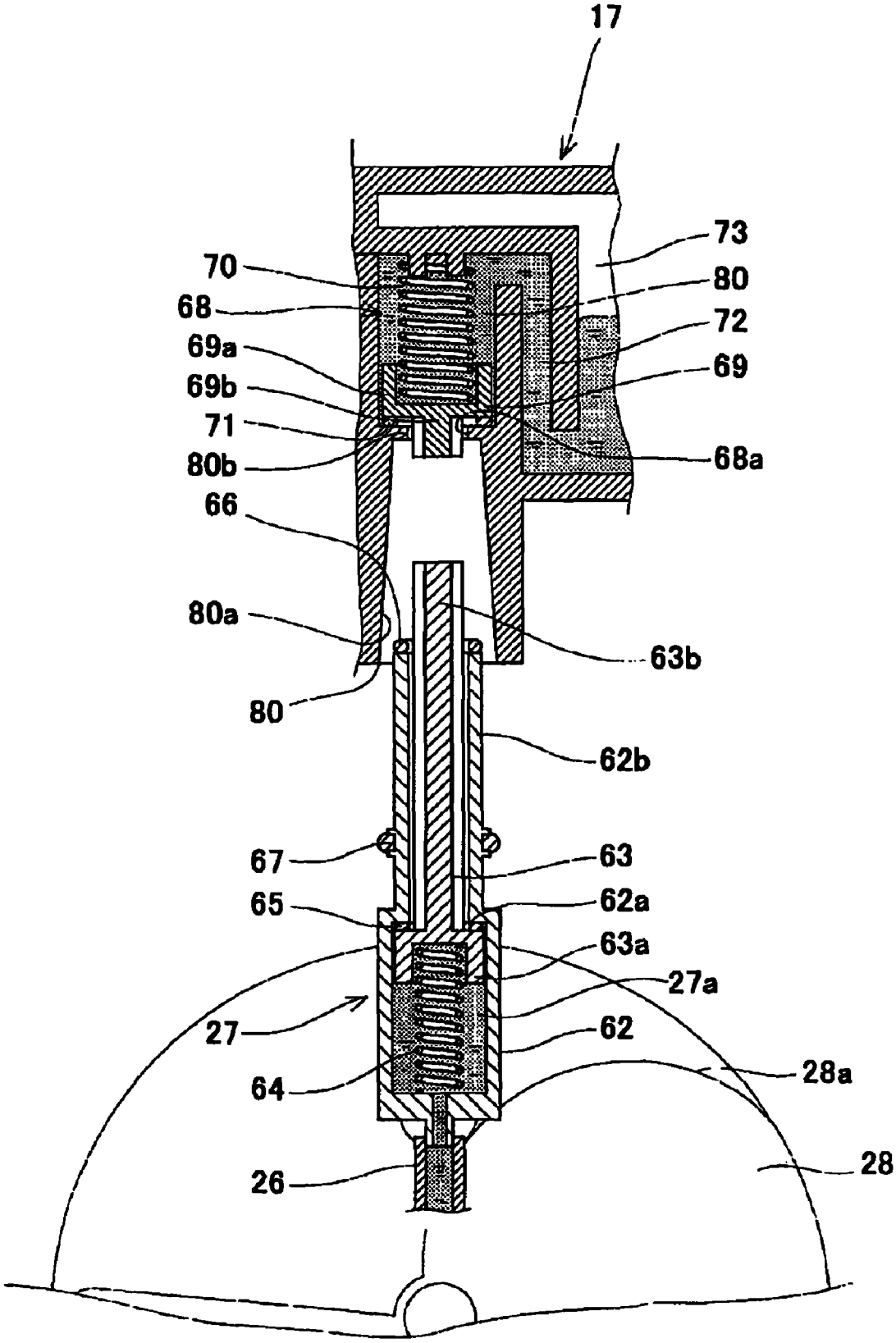
FIG. 5 shows a cross-sectional view of a first and a second joint part.

A sealing ring 65 is attached to the inner circumference surface of the casing 62. The sealing ring 65 is disposed at the surroundings of the outlet hole 62*a*. The sealing ring 65 is disposed between the casing 62 and the base part 63*a* of the second opening and closing valve 63. A coiled spring 64 makes contact with the base part 63*a* of the second opening and closing valve 63. The coiled spring 64 biases the base part 63*a* toward the sealing ring 65. In a normal state (a state where the second joint part 27 is not connected with the sub tank 17), the base part 63*a* makes contact with the sealing ring 65. An ink path 27*a* (see FIG. 5) within the second joint part 27 is thus closed by the second opening and closing valve 63 because the sealing ring 65 creates a seal between the base part 63*a* and the inner circumference surface of the casing 62. Moreover, when the base part 63*a* is making contact with the sealing ring 65, the shaft part 63*b* protrudes upward beyond the first sealing member 66.

In the case where the shaft part 63*b* of the second opening and closing valve 63 has been pushed back by resistance from a first opening and closing valve 69 (to be described), the second opening and closing valve 63 separates from the sealing ring 65 against the biasing force of the coiled spring 64. In this case, the ink path 27*a* within the second joint part 27 is opened. Further, in the case where negative pressure equal to or above a predetermined value has been formed in the ink storage chamber 49 or the ink supply tube 26, as well, the second opening and closing valve 63 separates from the sealing ring 65 against the biasing force of the coiled spring 64. Moreover, the spring constant of the coiled spring 64 is set such that negative pressure that is transmitted from the main tank 25 to the discharge head 16 when the second joint part 27 is connected to the first joint part 68 does not exceed the meniscus pressure (pressure destroying the meniscus) of the nozzle 16*a*.

A cam roller 28 is disposed below the casing 62. The cam roller 28 is connected to a driving axis 59. The driving axis 59 is connected with a driving source (not shown). When the driving axis 59 rotates, the cam roller 28 rotates in a clockwise or anti-clockwise direction. The cam roller 28 has a cam surface 28*a*. The cam surface 28*a* smoothly changes the distance in a radial direction to the driving axis 59. When the cam roller 28 rotates in an anti-clockwise direction from the state shown in FIG. 4, the cam surface 28*a* makes contact with a lower surface of the casing 62, and the second joint part 27 is raised. When the cam roller 28 rotates in a clockwise direction from the state where the second joint part 27 is in the raised position, the second joint part 27 descends along the cam surface 28*a*.

The sub tank 17 comprises the first joint part 68, an ink storage chamber 73, etc. In the case where the multi function device 1 is viewed from a plan view, the first joint part 68 is disposed in a position that corresponds to the second joint part 27. The first joint part 68 has a case part 68*b* that is formed integrally with an outer wall of the sub tank 17. An ink path 72 is formed within the case part 68*b*. The ink path 72 communicates with the ink storage chamber 73. An outlet hole 75 is formed in a lower wall of the sub tank 17. Ink 100 within the ink storage chamber 73 is supplied from the outlet hole 75 to the discharge head 16 (see FIG. 2). A communication hole 73*a* is formed in an upper wall of the ink storage chamber 73. The communication hole 73*a* communicates with a labyrinth path (not shown). The sub tank 17 has a pressure buffering chamber 83. The pressure buffering chamber 83 communicates with the labyrinth path. The pressure buffering chamber 83 is disposed at a left side of the first joint part 68. The pressure buffering chamber 83 has a negative pressure controlling valve 84 and a positive pressure controlling valve 85. In the case where negative pressure equal to or above a predetermined value has occurred in the pressure buffering chamber 83, the negative pressure controlling valve 84 causes the pressure buffering chamber 83 to communicate with the atmosphere. In the case where positive pressure equal to or above a predetermined value has occurred in the pressure buffering chamber 83, the positive pressure controlling valve 85 causes the pressure buffering chamber 83 to communicate with the atmosphere.

The case part 68*b* comprises an insertion hole 80 that is concave in the upward direction (that opens downward). The insertion hole 80 is determined by a taper part 80*a* and a flange part 80*b*. The inner diameter of the taper part 80*a* grows smaller as it extends upward. The flange part 80*b* protrudes inward in a radial direction from an upper edge of the taper part 80*a*. A valve space 81 is formed above the flange part 80*b* and communicates with the ink storage chamber 73 via the ink path 72. The flange part 80*b* separates the valve space 81 and the insertion hole 80. A space at an inner side of the flange part 80*b* is an inlet hole 68*a*. The valve space 81 and the insertion hole 80 communicate via the inlet hole 68*a*.

The first joint part 68 comprises the first opening and closing valve 69. The first opening and closing valve 69 is inserted into the valve space 81 in the case part 68*b*. The first opening and closing valve 69 is capable of moving in the vertical direction along the case part 68*b*. The first opening and closing valve 69 has a base part 69*a* and a shaft part 69*b*. There is a clearance between the base part 69*a* and an inner circumference surface of the case part 68*b*. This clearance allows communication between an upper side and a lower side of the base part 69*a*. Further, the shaft part 69*b* protrudes downward from the base part 69*a*. In the inlet hole 68*a* there is a clearance between the shaft part 69*b* and the case part 68*b* (the flange part 80*b*). This clearance communicates between the valve space 81 at the upper side of the inlet hole 68*a* and the insertion hole 80 at the lower side of the inlet hole 68*a*.

The shaft part 69*b* of the first opening and closing valve 69 and the shaft part 63*b* of the second opening and closing valve 63 are formed on the same axis. The shaft part 69*b* and the shaft part 63*b* face one another. A sealing ring 71 is attached to the inner circumference surface of the case part 68*b*. The sealing ring 71 is disposed at the surroundings of the inlet hole 68*a*. The sealing ring 71 is disposed between the case part 68*b* and the base part 69*a* of the first opening and closing valve 69. A coiled spring 70 makes contact with the base part 69*a* of the first opening and closing valve 69. The coiled spring 70 biases the base part 69*a* toward the sealing ring 71. That is, the first opening and closing valve 69 and the second opening and closing valve 63 are biased by the coiled springs 64 and 70 in a direction of approaching one another. In the normal state (the state where the second joint part 27 is not making contact with the sub tank 17), the base part 69*a* makes contact with the sealing ring 71. The ink path 72 within the first joint part 68 is thus closed by the first opening and closing valve 69 because the sealing ring 71 creates a seal between the base part 69*a* and the inner circumference surface of the case part 68*b*. The ink path 72 is formed in spaces between the case part 68*b* and the first opening and closing valve 69 (a space of the inlet hole 68*a*, a space between the sealing ring 71 and the first opening and closing valve 69, etc.). Moreover, the spring constant of the coiled spring 70 of the first joint part 68 is greater than the spring constant of the coiled spring 64 of the second joint part 27. As a result, when the shaft parts 63*b* and 69*b* strike against one another, the second opening and closing valve 63 is pushed downward by the shaft part 69*b*.

The ink jet recording device 3 having the above configuration is a station supply type ink jet recording device. In the case where ink is to be replenished from the main tank 25 to the sub tank 17, the image recording unit 15 is moved until the first joint part 68 of the sub tank 17 is located above the second joint part 27. Then the first joint part 68 and the second joint part 27 are connected, and an ink replenishment operation is performed.

Figure 11A:
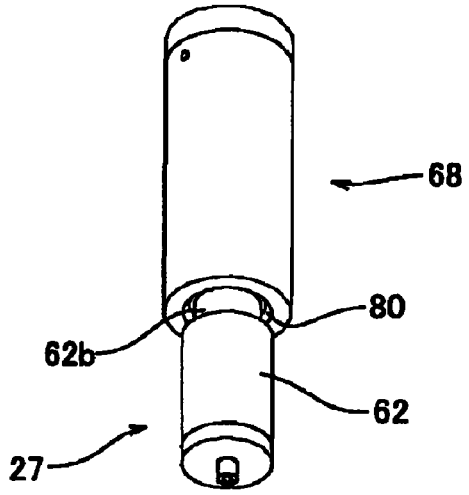
FIG. 11A shows the first and the second joint part which are in the connected state.
Figure 11B:
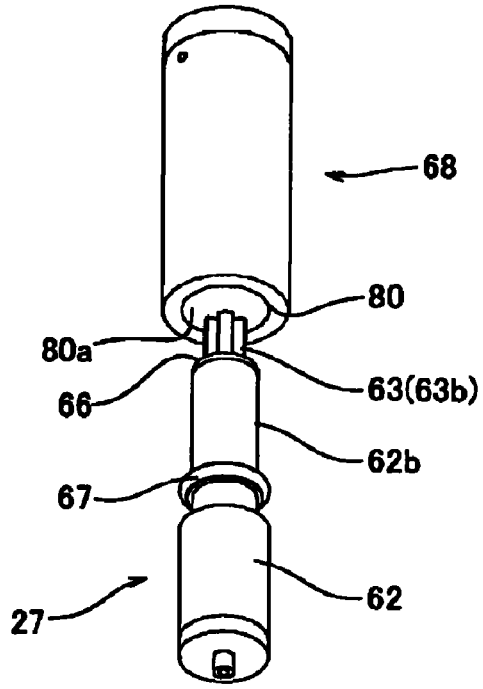
FIG. 11B shows the first and the second joint part which are in the disconnected state.

The ink replenishment operation will be described with reference to FIGS. 5 to 14. FIGS. 5 to 10 show the sequence of the process for connecting the second joint part 27 to the first joint part 68. FIGS. 5 to 10 correspond to the same cross-sectional view as in FIG. 4, and the first joint part 68 and the second joint part 27 are shown in an enlarged manner. Further, FIG. 11A and FIG. 11B show perspective views of the first joint part 68 and the second joint part 27.

As shown in FIG. 4, the cam roller 28 is driven to rotate in the anti-clockwise direction when the first joint part 68 and the second joint part 27 are in a separated state. The second joint part 27 thereby moves upward (in the inserting direction). The second joint part 27 is inserted into the insertion hole 80 of the first joint part 68.

Figure 6:
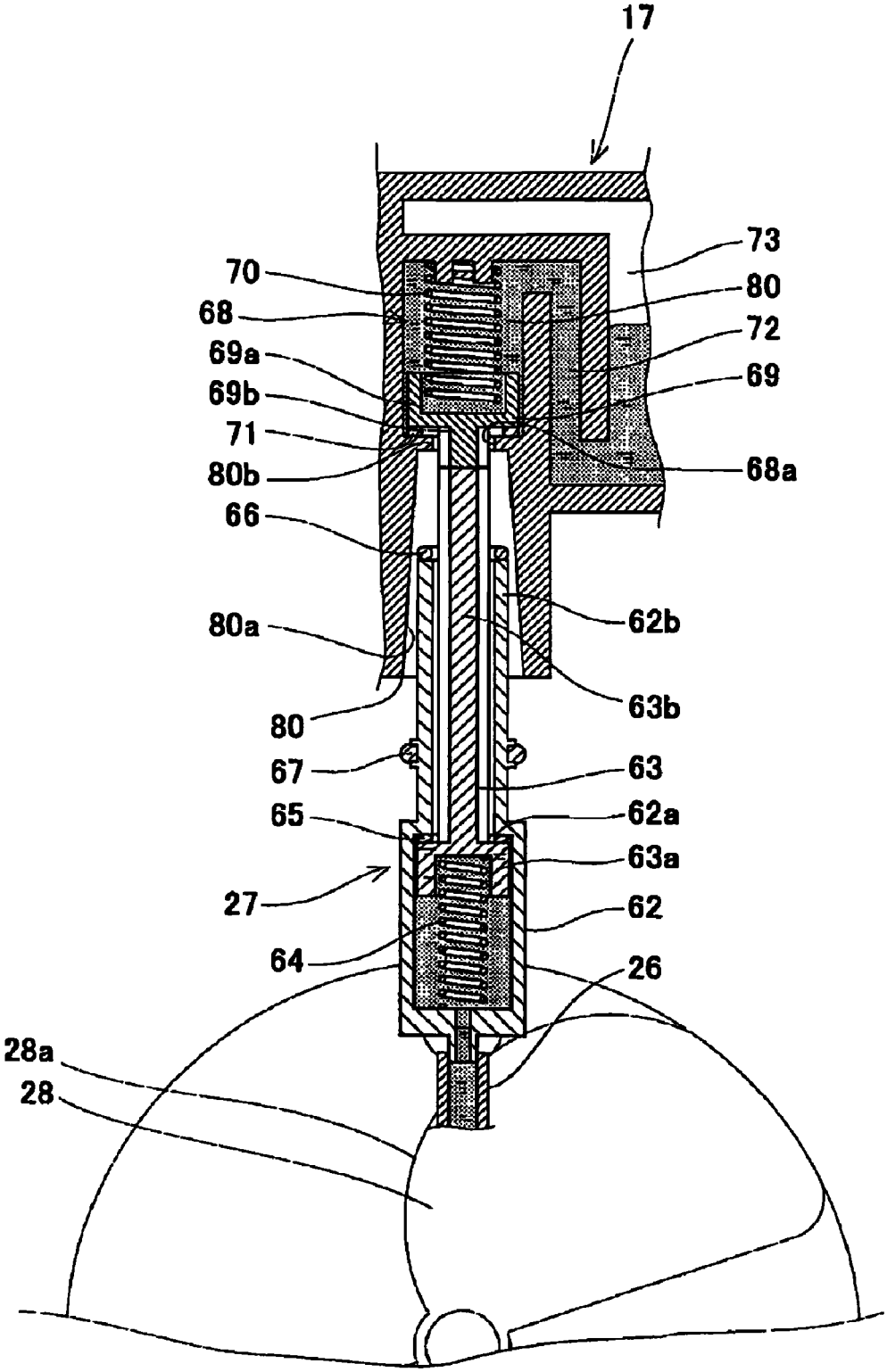
FIG. 6 shows a cross-sectional view of the first and the second joint part. A figure is shown in which the second joint part has been raised from the state of FIG. 5.
Figure 7:
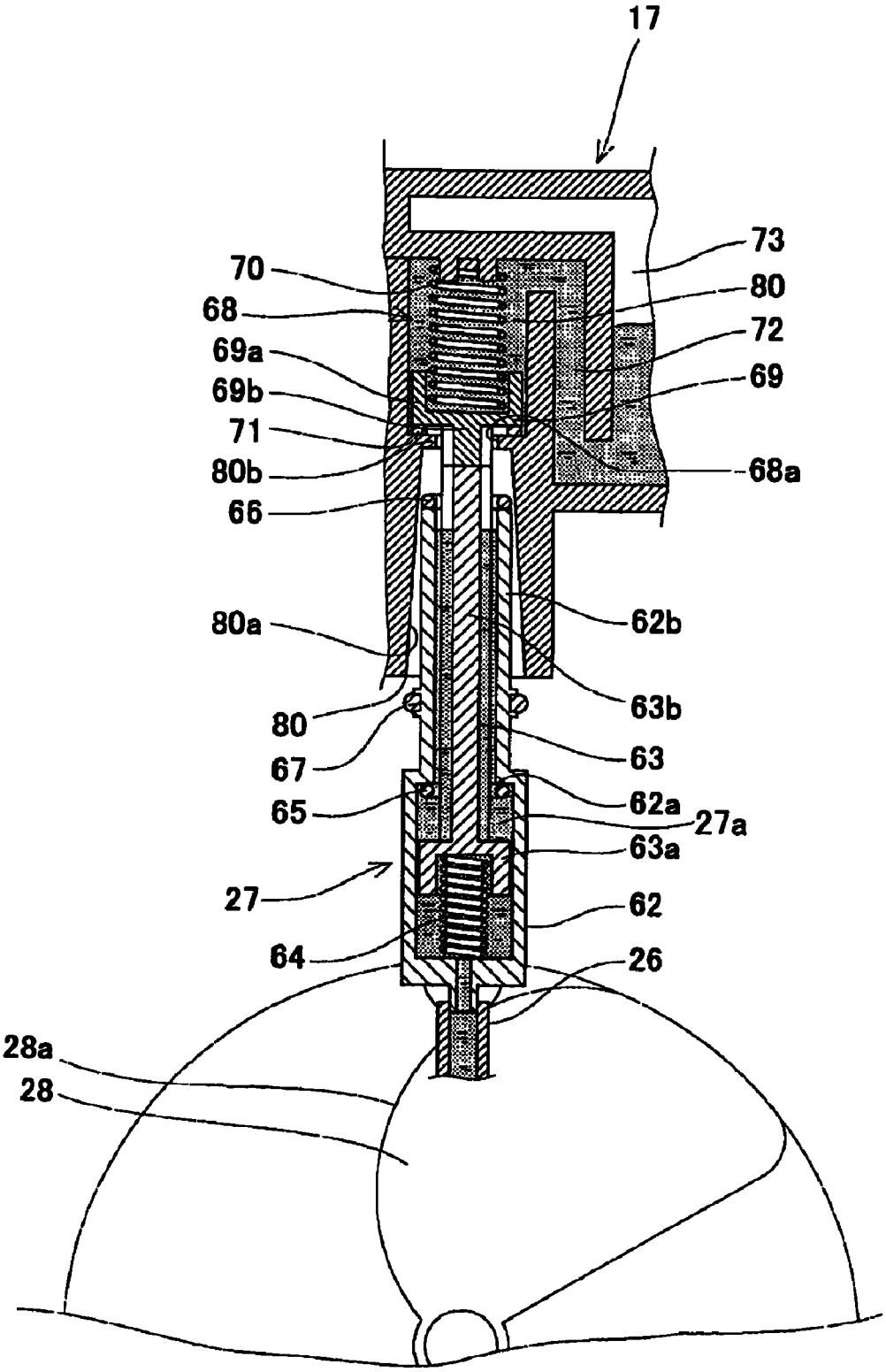
FIG. 7 shows a cross-sectional view of the first and the second joint part. A figure is shown in which the second joint part has been raised from the state of FIG. 6.
Figure 8:
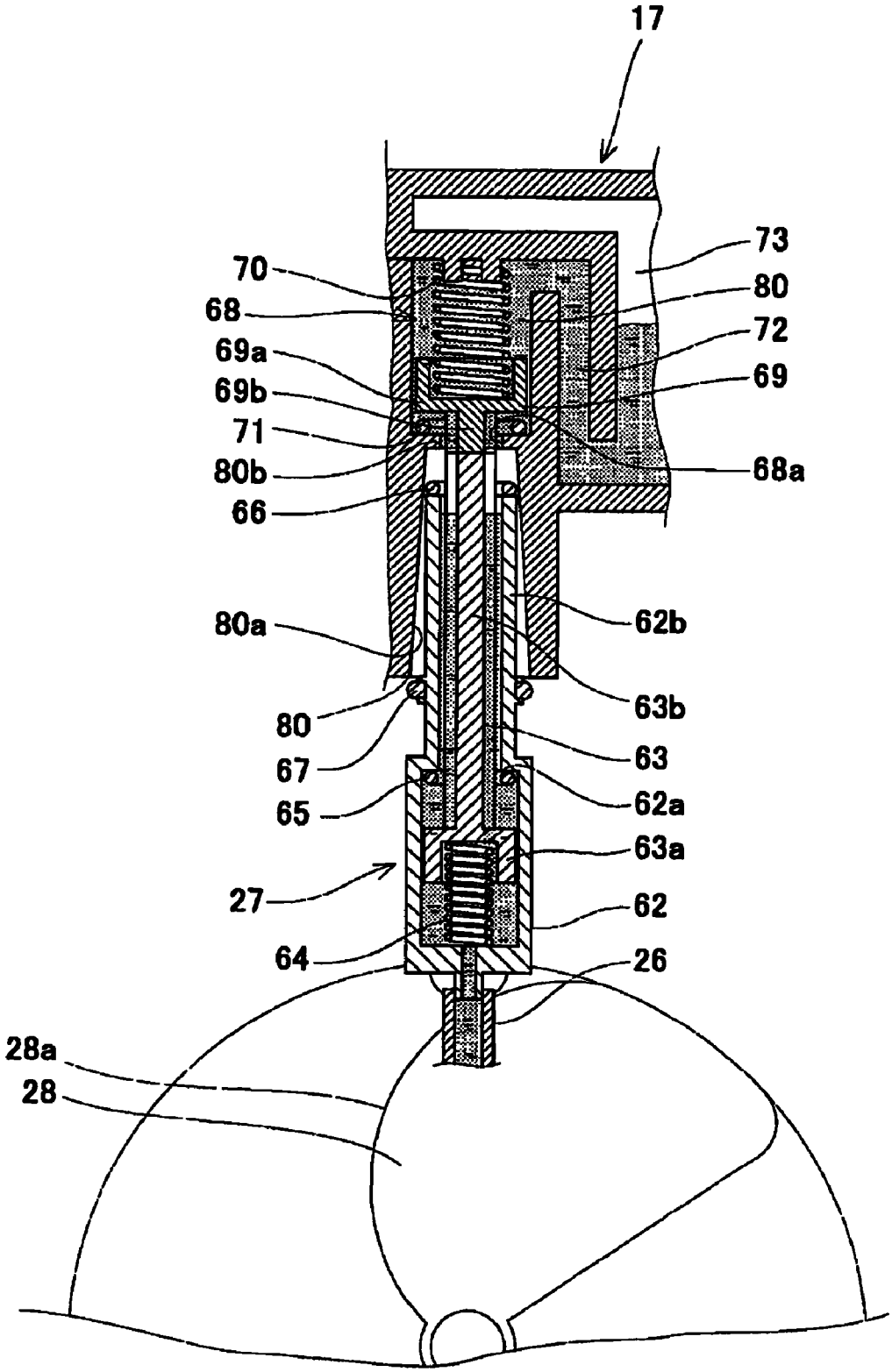
FIG. 8 shows a cross-sectional view of the first and the second joint part. A figure is shown in which the second joint part has been raised from the state of FIG. 7.
Figure 9:
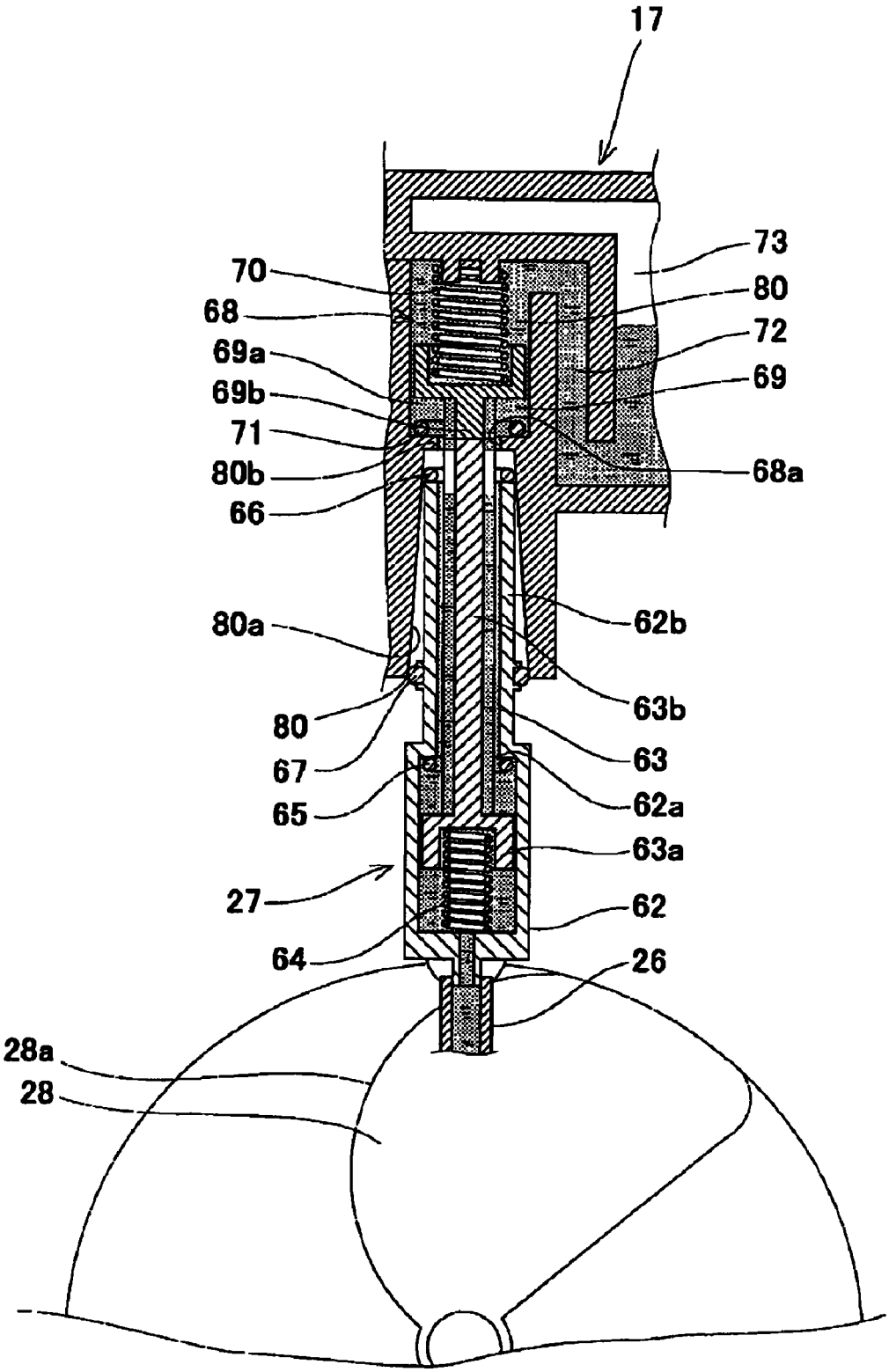
FIG. 9 shows a cross-sectional view of the first and the second joint part. A figure is shown in which the second joint part has been raised from the state of FIG. 8.
Figure 10:
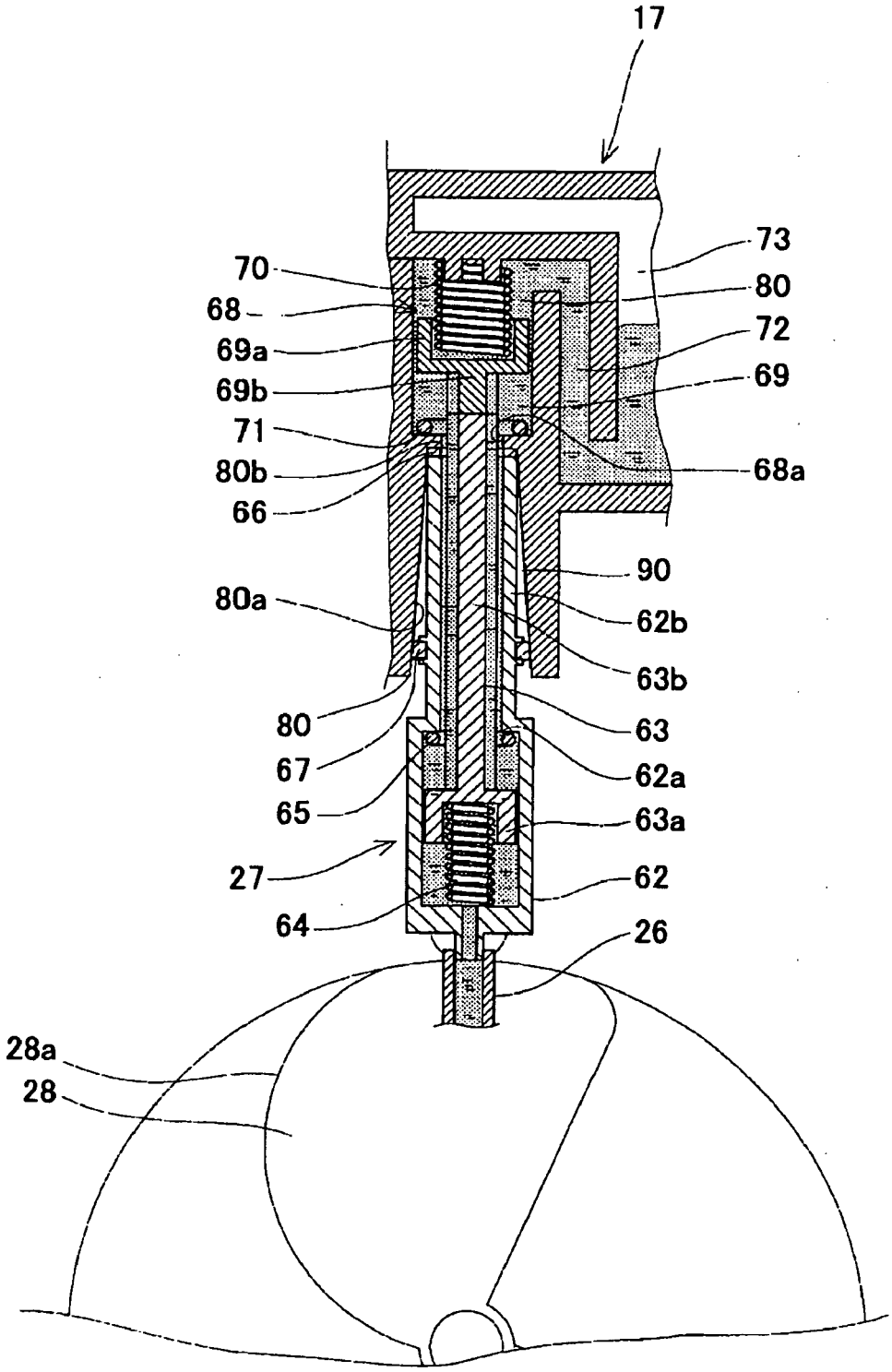
FIG. 10 shows a cross-sectional view of the first and the second joint part. A figure is shown in which the second joint part has been raised from the state of FIG. 9.

When the second joint part 27 is inserted into the insertion hole 80 of the first joint part 68 (see FIG. 5), the shaft part 69*b* of the first opening and closing valve 69 and the shaft part 63*b* of the second opening and closing valve 63 make contact (see FIG. 6). As described above, the spring constant of the coiled spring 70 of the first opening and closing valve 69 is greater than the spring constant of the coiled spring 64 of the second opening and closing valve 63. As a result, the shaft part 63*b* is pushed downward by the shaft part 69*b*. The base part 63*a* of the second opening and closing valve 63 thereby separates from the sealing ring 65, and the ink path 27*a* opens (see FIG. 7). That is, the ink path 27*a* of the second joint part 27 opens earlier than the ink path 72 of the first joint part 68. The interior of the ink supply tube 26 is thus released to the atmosphere, and gas within the ink supply tube 26 and the main tank 25 can be released to the atmosphere.

Next, the shaft part 63*b* of the second opening and closing valve 63 pushes the shaft part 69*b* of the first opening and closing valve 69 back upward. The base part 69*a* of the first opening and closing valve 69 thus separates from the sealing ring 71 against the biasing force of the coiled spring 70, and the ink path 72 is opened (see FIG. 8). The second sealing member 67 enters the insertion hole 80 after the ink path 72 has been opened. The second sealing member 67 makes contact with the taper part 80*a*. The first sealing member 66 is not making contact with the flange part 80*b* at the moment when the second sealing member 67 makes contact with the taper part 80*a*. The taper part 80*a* grows narrower in diameter as it extends upward. As a result, while the second joint part 27 progresses upwards, an axis of the standing part 62*b* is guided to a location that is the same as an axis of the insertion hole 80. The second sealing member 67 receives a compressing force in a main direction that is a radial direction of the standing part 62*b*, and is compressed. That is, the second sealing member 67 is compressed in a horizontal direction. The second sealing member 67 seals between the standing part 62*b* of the second joint part 27 and the taper part 80*a* of the first joint part 68 (see FIG. 9).

Since the second sealing member 67 is compressed in the radial direction of the standing part 62*b*, the amount of compression in the vertical direction is small. As a result, the second sealing member 67 allows the second joint part 27 to be raised even when this second sealing member 67 is sealing between the standing part 62*b* and the taper part 80*a*. When the second joint part 27 is raised further, the first sealing member 66 makes contact with the flange part 80*b*. The first sealing member 66 is compressed in the vertical direction between the flange part 80*b* and an upper end part of the standing part 62*b*. The first sealing member 66 seals between the standing part 62*b* of the second joint part 27 and the flange part 80*b* of the first joint part 68. The connection of the first joint part 68 and the second joint part 27 is thus completed (see FIG. 10 and FIG. 11A).

In the present embodiment, it is possible to fix the position of the first sealing member 66 with respect to the flange part 80*b* while the second sealing member 67 has achieved a seal. The first sealing member 66 can thus be made to make contact reliably with the flange part 80*b*. As a result, it is possible to achieve a reliable seal between the first joint part 68 and the standing part 62*b* in the radial direction and the axial direction. The ink path 27*a* of the second joint part 27 communicates with the ink path 72 of the first joint part 68. The main tank 25 and the sub tank 17 thus communicate, and the ink replenishment path 26, 27*a*, 72 is in a connected state.

The first joint part 68 and the second joint part 27 achieve a seal in the radial direction and the axial direction. This point will now be described in a little more detail. A lower surface of the flange part 80*b* of the first joint part 68 extends along a horizontal plane. Further, an inner surface of the taper part 80*a* of the first joint part 68 extends along a substantially vertical plane. That is, the lower surface of the flange part 80*b* has a substantially perpendicular relationship to the inner surface of the taper part 80*a*. Further, an upper surface of the standing part 62*b* of the second joint part 27 extends along a horizontal plane. Further, an outer surface of the standing part 62*b* of the second joint part 27 extends along a substantially vertical plane. That is, the upper surface of the standing part 62*b* and the outer surface of the standing part 62*b* have a substantially perpendicular relationship. When the first joint part 68 and the second joint part 27 are in a connected state, the lower surface of the flange part 80*b* faces the upper surface of the standing part 62*b*, and the first sealing member 66 seals between the two. Further, the inner surface of the taper part 80*a* faces the outer surface of the standing part 62*b*, and the second sealing member 67 seals between the two.

There is a possibility that there will be a misalignment from the positional relationship in which the first joint part 68 and the second joint part 27 are connected satisfactorily. For example, the standing part 62*b* may move downward while the first joint part 68 and the second joint part 27 are in the connected state. In this case, the first sealing member 66 may separate from the first joint part 68. The second sealing member 67 may achieve a seal even in this state, and it is consequently possible to prevent ink from leaking. Further, for example, the standing part 62*b* may be inserted with a misaligned axis into the insertion hole 80. In this case, a space may be formed between the second sealing member 67 and the first joint part 68. The first sealing member 66 may achieve a seal even in this state, and it is consequently possible to prevent ink from leaking. In the present embodiment, the first sealing member 66 that is compressed in the axial direction, and the second sealing member 67 that is compressed in the radial direction are both utilized. As a result, at least one out of the first sealing member 66 and the second sealing member 67 can achieve a seal even if there is a misalignment from the positional relationship in which the first joint part 68 and the second joint part 27 are connected satisfactorily. It is consequently possible to prevent unsatisfactory ink supply caused by a poor seal. Furthermore, dust proofing of the connecting portions can be improved. It is possible to prevent ink leakage caused by a poor seal.

In the station type ink jet recording device 3 of the present embodiment, the discharge head 16 and the sub tank 17 move in the scanning direction, and the second joint part 27 moves in a vertical direction that is perpendicular to the scanning direction. As a result, the standing part 62*b* may be inserted with a misaligned axis into the insertion hole 80. In this case, one out of the first sealing member 66 and the second sealing member 67 may make partial contact with the first joint part 68. In this condition, as well, the other of the sealing members is capable of achieving a seal. The seal configuration of the present embodiment is suitable for being utilized in the station type ink jet recording device 3.

Figure 12:
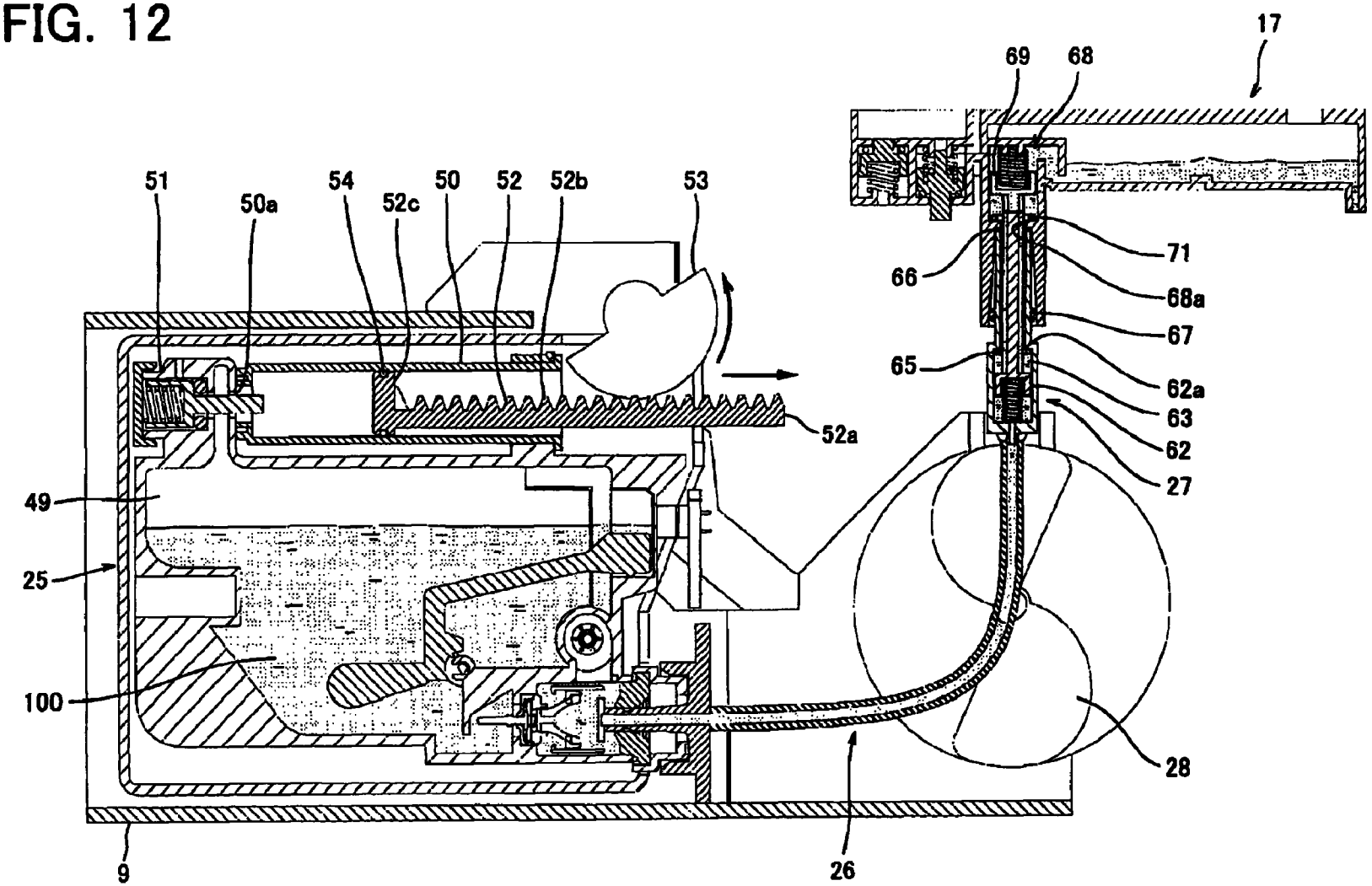
FIG. 12 shows a cross-sectional view of the ink jet recording device. A figure is shown for describing how ink returns from a sub tank to a main tank.

FIG. 12 is a figure for describing how ink returns from the sub tank 17 to the main tank 25. FIG. 12 corresponds to the same cross-section as FIG. 4. A driving source (not shown) causes the pinion gear 53 of the main tank 25 to rotate in an anti-clockwise direction. The piston 52 is thus moved away from the insertion hole 50*a*. Negative pressure is formed in the ink storage chamber 49 of the main tank 25. The ink within the sub tank 17 is sucked by this negative pressure into the main tank 25 via the ink supply tube 26.

Figure 13:
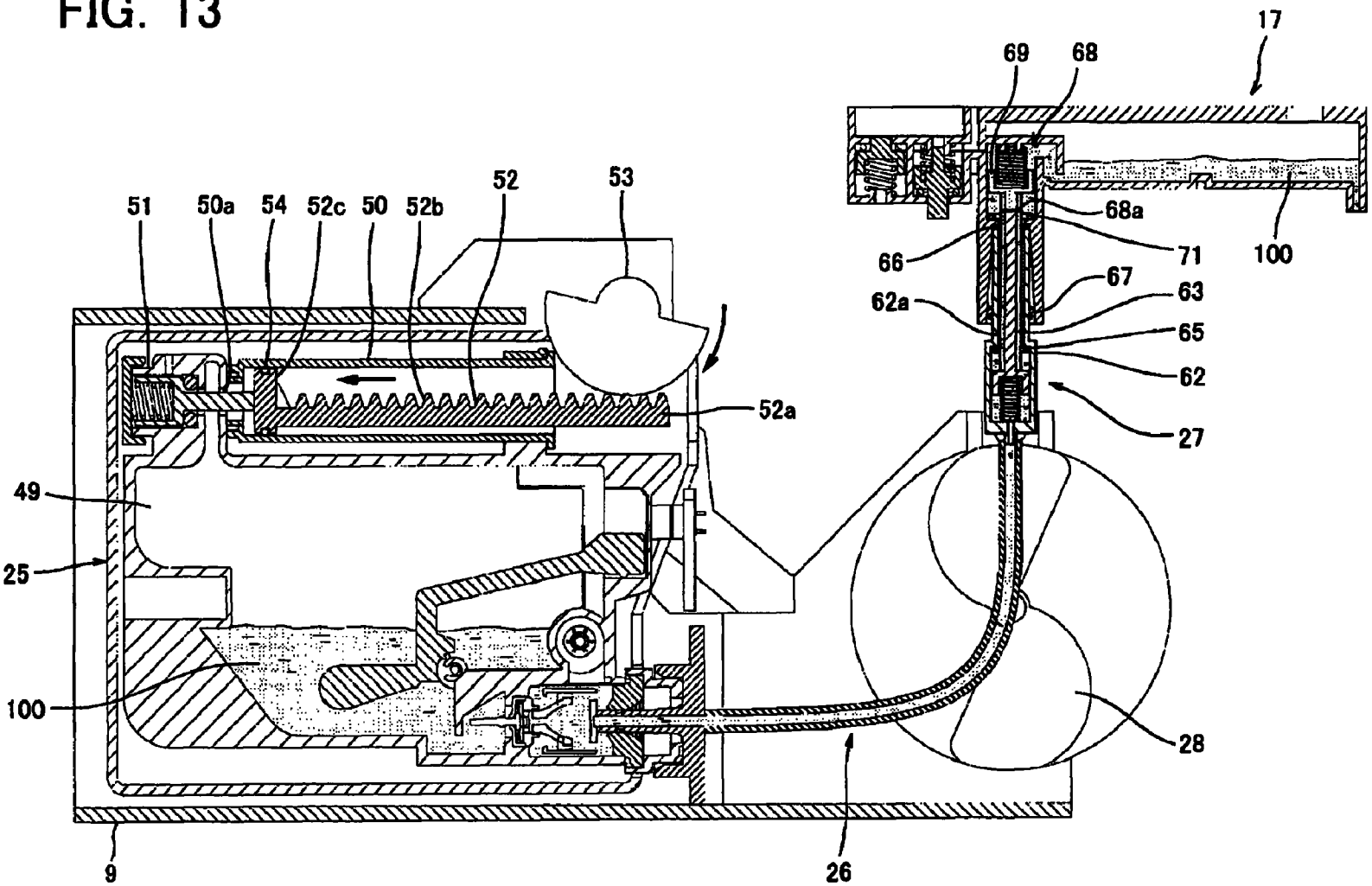
FIG. 13 shows a cross-sectional view of the ink jet recording device. A figure is shown for describing how ink is replenished from the main tank to the sub tank.

FIG. 13 is a figure for describing how ink is replenished from the main tank 25 to the sub tank 17. FIG. 13 corresponds to the same cross-section as FIG. 4. When the pinion gear 53 of the main tank 25 rotates in a clockwise direction, the piston 52 moves towards the insertion hole 50*a*. Positive pressure is formed in the ink storage chamber 49 of the main tank 25. The ink within the ink storage chamber 49 of the main tank 25 is supplied by this positive pressure to the sub tank 17 via the ink supply tube 26. The amount of ink replenished into the sub tank 17 at this juncture is set to be an amount of ink equal to or greater than the amount estimated to be consumed in the next printing operation.

Figure 14:
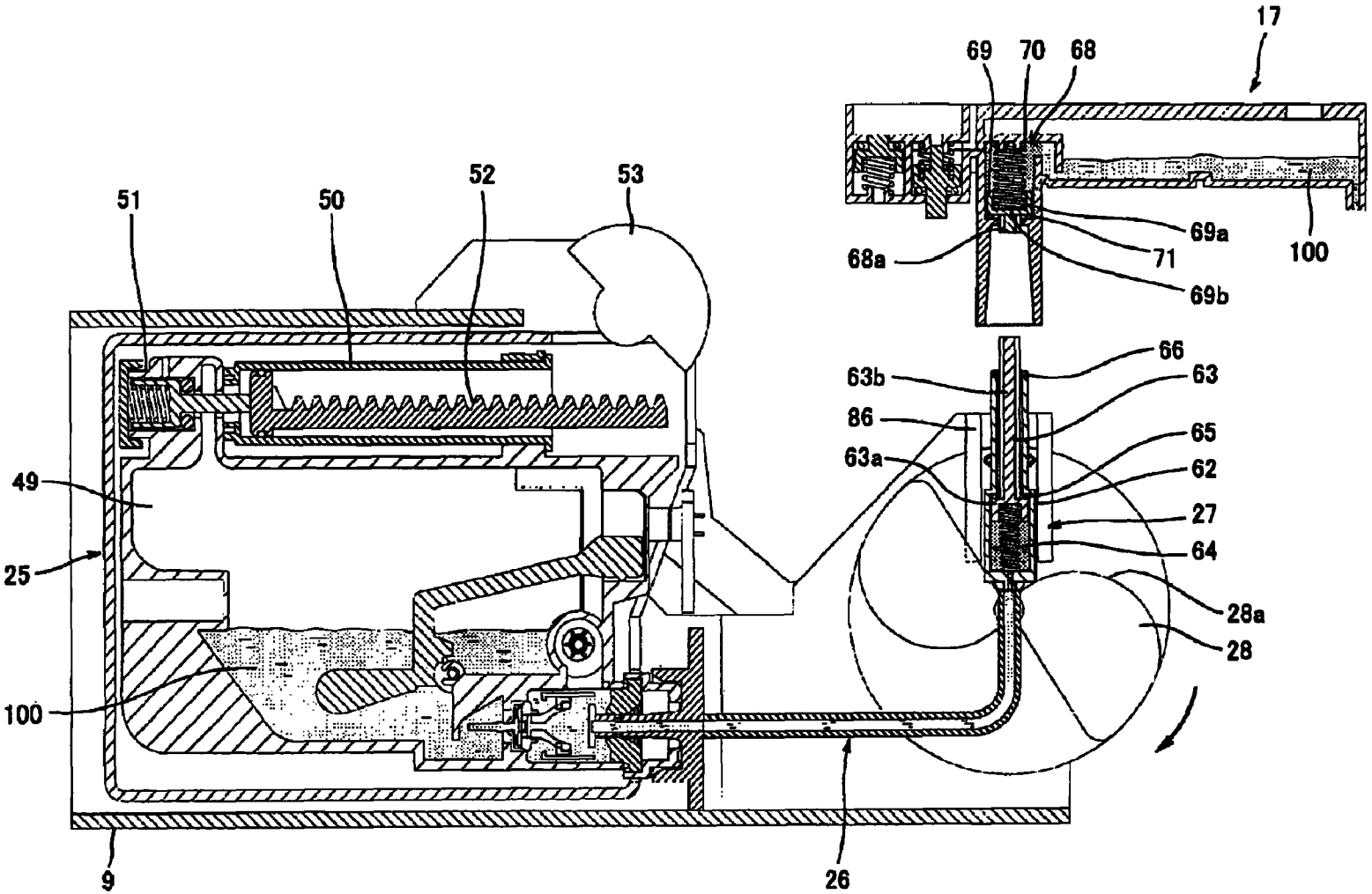
FIG. 14 shows a cross-sectional view of the ink jet recording device. A state is shown in which ink replenishment has been completed.

FIG. 14 shows a state in which the ink replenishment of the sub tank 17 has been completed. FIG. 14 corresponds to the same cross-section as FIG. 4. When the ink replenishment of the sub tank 17 has been completed, the cam roller 28 rotates in the clockwise direction, and the second joint part 27 is lowered. The first joint part 68 and the second joint part 27 are thus disconnected. First, the first sealing member 66 separates from the flange part 80*b* (see FIG. 9). Next, the second sealing member 67 separates from the taper part 80*a*. The base part 69*a* of the first opening and closing valve 69 fits with the sealing ring 71 due to the biasing force of the coiled spring 70. The ink path 72 is thus closed (see FIG. 7). Further, the base part 63*a* of the second opening and closing valve 63 fits with the sealing ring 65 due to the biasing force of the coiled spring 64. The ink path 27*a* is thus closed (see FIG. 6). When the second joint part 27 is lowered further (see FIG. 5), the second joint part 27 separates from the insertion hole 80 (see FIG. 14).

In the present embodiment, the insertion hole 80 of the first joint part 68 opens downward. There is a possibility that, when ink remains in the insertion hole 80, this ink will fall onto the paper 11 when the image recording unit 15 is scanning above the paper 11. To deal with this, the second joint part 27 is formed to the exterior side of the transferring path 12 (see FIG. 2). As a result, ink that has adhered to the second joint part 27 does not fall onto the paper 11 that is being transferred along the transferring path 12 (see FIG. 2). With the configuration of the present embodiment, the first sealing member 66 and the second sealing member 67 are attached to the second joint part 27. When the second joint part 27 is to be separated from the first joint part 68, the second joint part 27 takes in ink remaining in the first sealing member 66 and in the second sealing member 67. Therefore, ink may be prevented from remaining in the insertion hole 80. With the present embodiment, ink may be prevented from falling from the first joint part 68 onto the paper 11 that is being transferred along the transferring path 12.

Further, in the present embodiment, the second joint part 27 is inserted into the first joint part 68 from below. The amount that the ink supply tube 26 must be moved may be smaller than in the case where the second joint part 27 is inserted from above or horizontally. Since the amount that the amount that the ink supply tube 26 must be moved is small, air drift within the ink supply tube 26 may be controlled.

The first sealing member 66 is disposed further toward the first joint part 68 than the second sealing member 67. The second sealing member 67 may be disposed as far downward as possible. In this case, it is possible to ensure that a space (see FIG. 10) between the first joint part 68, the second sealing member 67, and the second joint part 27 has a large capacity. When the mutual position of the first joint part 68 and the second joint part 27 changes, the capacity of the space changes. However, since the capacity of the space is kept large, the capacity of the space changes by a small amount. As a result, the change in internal pressure of the space can be kept small. The amount of change in internal pressure applied to the first sealing member 66 and the second sealing member 67 can consequently be reduced, and a satisfactory seal can be achieved.

Second Embodiment

Figure 15:
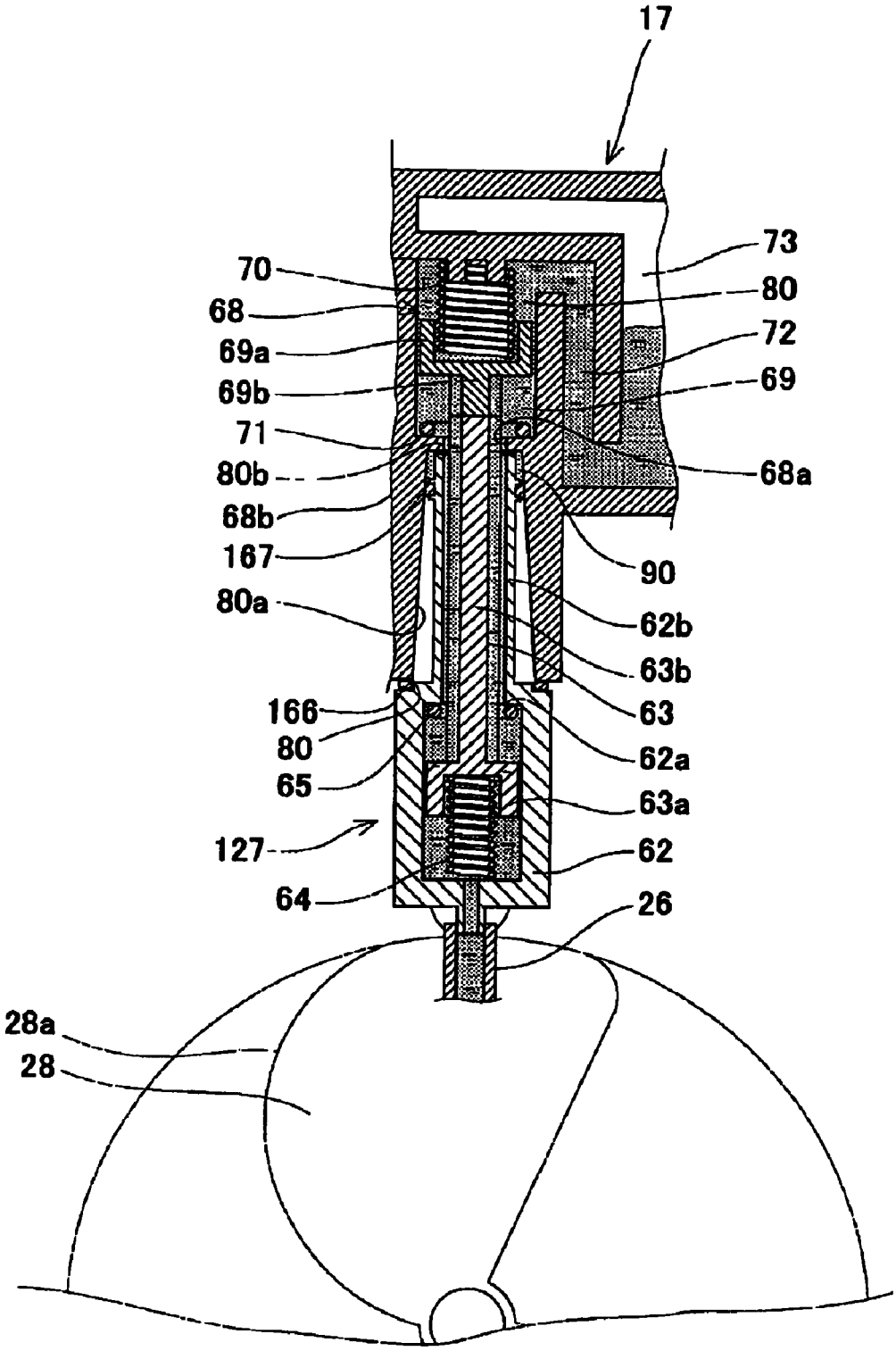
FIG. 15 shows a cross-sectional view of a first and a second joint part of another embodiment.

FIG. 15 shows joint portions of an ink jet recording device of a second embodiment. The present embodiment differs from the first embodiment in the position of a first sealing member 166 and a second sealing member 167. Other points are the same as in the first embodiment. The same reference numbers are applied to the component parts that have the same configuration as those in the first embodiment, and a description of those component parts is omitted.

The first sealing member 166 is attached to a peripheral edge part of the upper wall of the casing 62. Further, the second sealing member 167 is attached to an outer circumference surface of the standing part 62*b*. The second sealing member 167 is disposed upward from a central position of the standing part 62*b* in the vertical direction thereof. The first sealing member 166 is compressed in the vertical direction between the upper wall of the casing 62 and the lower wall of the sub tank 17 (a lower wall of the case part 68*b*). The first sealing member 166 thus seals between the first joint part 68 and a second joint part 127. The second sealing member 167 is compressed in a horizontal direction between the standing part 62*b* and the taper part 80*a* of the sub tank 17. The second sealing member 167 thus seals between the first joint part 68 and the second joint part 127.

Third Embodiment

Figure 16:
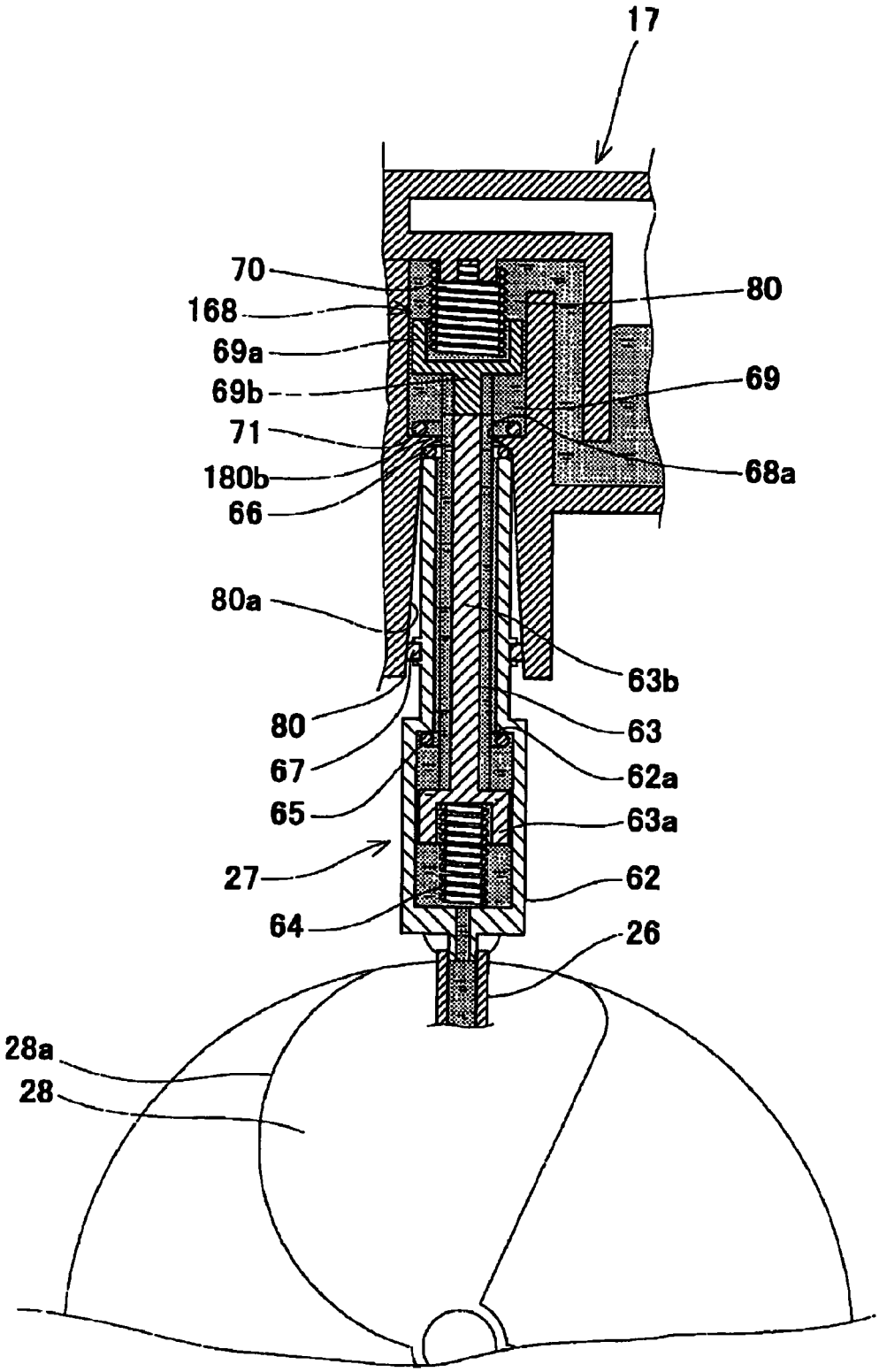
FIG. 16 shows a cross-sectional view of a first and a second joint part of another embodiment.

FIG. 16 shows joint portions of an ink jet recording device of a third embodiment. The present embodiment differs from the first embodiment in the configuration of a flange part 180*b* of a first joint part 168. Other points are the same as in the first embodiment. The same reference numbers are applied to the component parts that have the same configuration as those in the first embodiment, and a description of those component parts is omitted.

A side surface of the flange part 180*b*, which is opposite from the valve space 81, is slanted, growing narrower in diameter as it extends upward. With this configuration, as well, the first sealing member 66 is compressed in the vertical direction between the standing part 62*b* and the flange part 180*b*. Further, the flange part 180*b* may equally well have another shape capable of compressing the first sealing member 66 by means of force in a main direction that is the vertical direction. With the present embodiment, it is possible to achieve a seal in the axial direction by means of the first sealing member 66, and to achieve a seal in the radial direction by means of the second sealing member 67.

Fourth Embodiment

Figure 17:
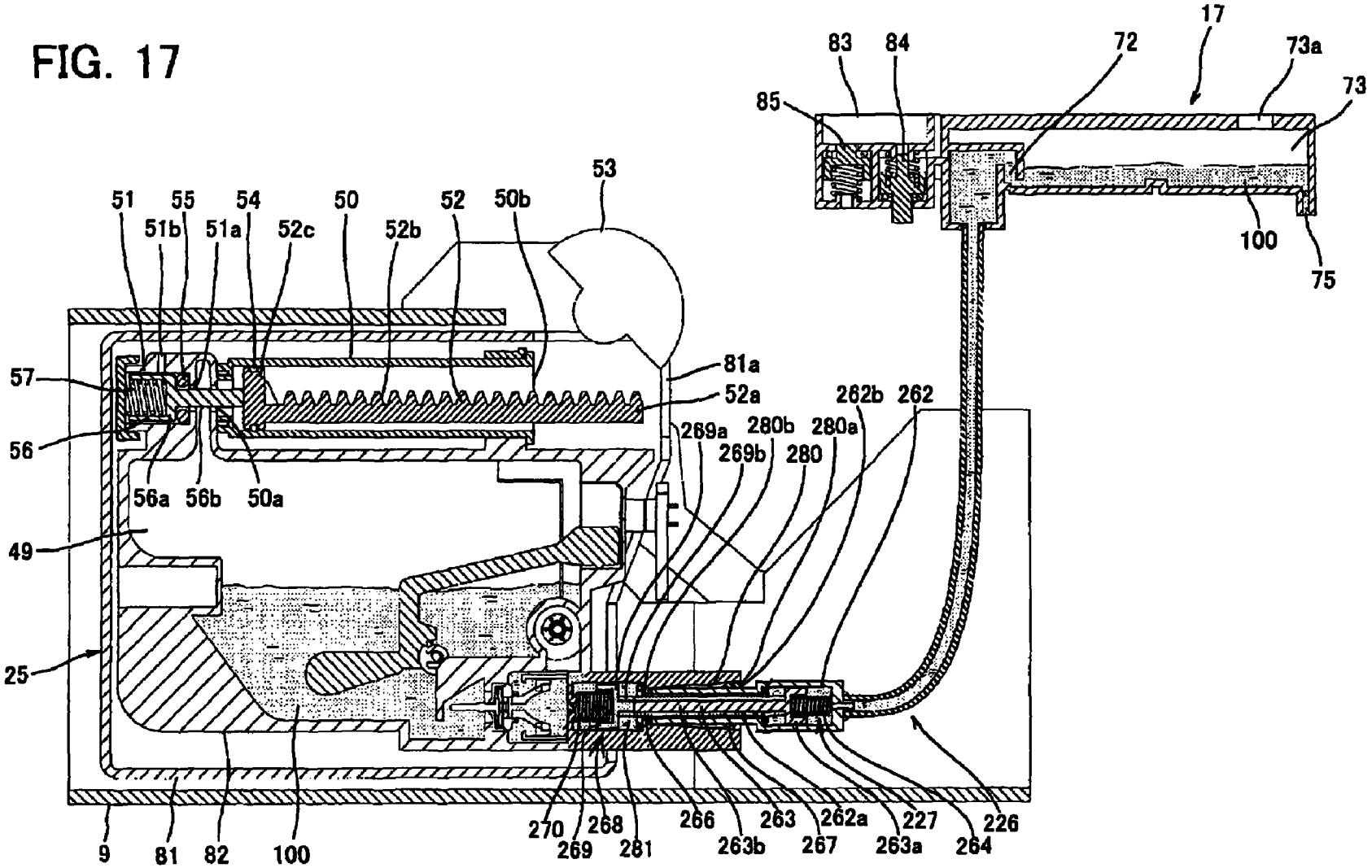
FIG. 17 shows a cross-sectional view of an ink jet recording device of another embodiment.

FIG. 17 shows an ink jet recording device of a fourth embodiment. FIG. 17 corresponds to the same cross-section as FIG. 4. The present embodiment differs from the first embodiment in that an ink supply tube 226 and a sub tank 17 are usually connected. That is, the present embodiment shows an ink jet recording device of a tube supply type. In the above first to third embodiments, the ink jet recording devices of the station supply type have been shown. In the station supply type, an ink replenishment path is to be a connected state only when ink replenishment is necessary (or during a waiting status of the ink jet recording device), and the ink replenishment path is to be a disconnected state during an image recording operation. On the other hand, in the tube supply type, an ink replenishment path is to be a connected state during not only the waiting status but also the image recording operation. That is, the ink replenishment path is always in the connected state while the main tank is connected with the tube.

In the present embodiment, the configuration of the joint parts differs from that of the first embodiment. Other points are the same as in the first embodiment. The same reference numbers are applied to the component parts that have the same configuration as those in the first embodiment, and a description of those component parts is omitted.

A main tank side joint part 268 is formed at a lower part of the main tank 25. A valve space 281 of the main tank side joint part 268 communicates with the ink storage chamber 49. An opening and closing valve 269 is inserted into the valve space 281. The opening and closing valve 269 has a base part 269*a* and a shaft part 269*b*. A coiled spring 270 makes contact with the base part 269*a*. The main tank side joint part 268 comprises an insertion hole 280. The insertion hole 280 opens towards the right. The insertion hole 280 is determined by a taper part 280*a* and a flange part 280*b*.

A sub tank side joint part 227 is connected to one end of the ink supply tube 226. A housing 262 of the sub tank side joint part 227 communicates with the ink supply tube 226. The sub tank side joint part 227 comprises a standing part 262*a* that extends towards the left from a left wall of the housing 262. The sub tank side joint part 227 is fixed to the main tank mounting part 9. The sub tank side joint part 227 comprises an opening and closing valve 263. The opening and closing valve 263 has a base part 263*a* and a shaft part 263*b*. A coiled spring 264 makes contact with the base part 263*a*. A first sealing member 266 is attached to a left side part of the standing part 262*a*. A second sealing member 267 is attached to the standing part 262*a* at a position that is to the right of a central position thereof in the left-right direction.

When the main tank 25 is to be mounted in the main tank mounting part 9, the main tank 25 (the main tank side joint part 268) is moved in a horizontal direction toward the sub tank side joint part 227. First, the second sealing member 267 is compressed in a vertical direction between the sub tank side joint part 227 and the main tank side joint part 268. The second sealing member 267 thus seals between the two joint parts 227 and 268. Next, the first sealing member 266 is compressed in a horizontal direction between the sub tank side joint part 227 and the main tank side joint part 268. The first sealing member 266 thus seals between the two joint parts 227 and 268.

The other end of the ink supply tube 226 is usually connected with the sub tank 17. When the main tank 25 and the ink supply tube 226 are connected, the main tank 25 and the sub tank 17 communicate. The sub tank 17 can be replenished with ink from the main tank 25.

The technique set forth in the above embodiments may be applied to a liquid discharge device other than an ink jet recording device. For example, the technique set forth in the above embodiments may be applied to a device for discharging a solder to make a print circuit.

In the above embodiments, the first sealing member 66 and the second sealing member 67 are attached to the second joint part 27. However, the first sealing member 66 and/or the second sealing member 67 may equally well be attached to the first joint part 68. Further, in the above embodiments, the direction of insertion of the second joint part 27 with respect to the first joint part 68 is a vertical direction (upward). However, the direction of insertion may equally well be a horizontal direction, or an oblique direction that is neither vertical nor horizontal.

In the above embodiments, only the second joint part 27 can move in the vertical direction. However, a configuration may be adopted in which only the first joint part 68 can move in the vertical direction. Further, a configuration may be adopted in which both the first joint part 68 and the second joint part 27 can move in the vertical direction. Further, a configuration having the first joint part 68 may be adopted at the main tank 25 side, and a configuration having the second joint part 27 may be adopted at the sub tank 17 side.

What is claimed is:

1. A liquid discharge device, comprising:

a discharge head comprising a nozzle for discharging liquid;

a first member communicating with the discharge head;

a second member capable of being connected to the first member, wherein a liquid path from a liquid supply source to the discharge head via the second member and the first member is formed when the second member is in a connected state with the first member, one of the first member and the second member comprises an insertion hole, and the second member is connected with the first member in a case where the other of the first member and the second member is inserted into the insertion hole by moving the first member and/or the second member in a predetermined direction;

a first sealing member that seals between the first member and the second member by being compressed in the predetermined direction when the second member is in the connected state with the first member; and a second sealing member that seals between the first member and the second member by being compressed in a direction which is perpendicular to the predetermined direction when the second member is in the connected state with the first member.

2. The liquid discharge device as in claim 1, further comprising:

a movement device that moves the first member and/or the second member in the predetermined direction.

3. The liquid discharge device as in claim 2, wherein the first member comprises the insertion hole, and the movement device moves the second member in the predetermined dire.

4. The liquid discharge device as in claim 3, wherein in a case where the second member is to be connected with the first member, the second sealing member seals first, then the first sealing member seals.

5. The liquid discharge device as in claim 1, wherein in the predetermined direction, the first sealing member is closer to the first member than the second sealing member.

6. The liquid discharge device as in claim 1, wherein the first sealing member and the second sealing member are coupled to the second member.

7. The liquid discharge device as in claim 1, further comprising:

a tank comprising the first member and a space for storing the liquid supplied from the liquid supply source via the second member and the first member, wherein the liquid within the space is to be supplied to the discharge head.

8. A liquid discharge device, comprising:

a discharge head comprising a nozzle for discharging liquid;

a first member communicating with the discharge head;

a second member capable of being connected to the first member, wherein a liquid path from a liquid supply source to the discharge head via the second member and the first member is formed when the second member is in a connected state with the first member; and at least two sealing members that seal between the first member and the second member when the second member is in the connected state with the first member, wherein the sealing members are configured separately, wherein the first member comprises a first surface and a second surface which is substantially perpendicular to the first surface, the second member comprises a third surface and a fourth surface which is substantially perpendicular to the third surface, when the second member is in the connected state with the first member, the first surface faces the third surface, and the second surface faces the fourth surface, one of the sealing members seals between the first surface and the third surface, and the other of the sealing members seals between the second surface and the fourth surface.

* * * * *